US009011039B2

(12) United States Patent
Oxford et al.

(10) Patent No.: US 9,011,039 B2
(45) Date of Patent: Apr. 21, 2015

(54) APPARATUSES FOR SERVICING ROADWAYS

(75) Inventors: Tom L. Oxford, Moyie Springs, ID (US); Stephen L. Monlux, Missoula, MT (US); Erik B. Skeen, Bonners Ferry, ID (US)

(73) Assignee: RM Equipment, LLC, Bonners Ferry, ID (US)

( * ) Notice: Subject to any disclaimer, the term of this patent is extended or adjusted under 35 U.S.C. 154(b) by 0 days.

(21) Appl. No.: 13/071,278

(22) Filed: Mar. 24, 2011

(65) Prior Publication Data

US 2012/0243939 A1 Sep. 27, 2012

(51) Int. Cl.

| | |
|---|---|
| ***E01C 23/08*** | (2006.01) |
| ***A01B 23/06*** | (2006.01) |
| ***A01B 3/00*** | (2006.01) |
| ***E01C 23/088*** | (2006.01) |

(52) U.S. Cl.

CPC ..... *E01C 23/088* (2013.01); *E01C 2301/50* (2013.01)

(58) Field of Classification Search

CPC ... E01C 23/088; E01C 23/065; A01B 33/142; A01B 49/02

USPC ..... 404/90, 122, 128, 129

See application file for complete search history.

(56) References Cited

U.S. PATENT DOCUMENTS

| | | | | |
|---|---|---|---|---|
| 1,806,054 | A * | 5/1931 | Gardner | 172/781 |
| 1,883,404 | A * | 10/1932 | Adolph | 172/71 |
| 1,921,688 | A | 8/1933 | McLaughlin | |
| 2,036,598 | A | 4/1936 | Miller et al. | |
| 2,397,782 | A * | 4/1946 | Flynn | 404/90 |
| 2,858,625 | A | 11/1958 | Rivinius | |
| 3,136,078 | A * | 6/1964 | Renault | 172/547 |
| 3,173,493 | A * | 3/1965 | Renault | 172/69 |
| 3,287,834 | A | 11/1966 | Hopkins | |
| 3,330,365 | A | 7/1967 | Mathers | |
| 3,375,764 | A * | 4/1968 | Petersen | 404/92 |
| 3,490,539 | A | 1/1970 | Hilmes et al. | |
| 3,638,539 | A | 2/1972 | Lewis | |
| 3,693,722 | A | 9/1972 | Brown | |
| 3,705,628 | A * | 12/1972 | King | 172/68 |
| 3,735,818 | A | 5/1973 | Swisher, Jr. et al. | |
| 3,767,262 | A * | 10/1973 | Pentith | 299/10 |
| 3,777,822 | A | 12/1973 | Stedman et al. | |
| 3,888,542 | A * | 6/1975 | Gowler | 299/1.5 |
| 4,154,481 | A * | 5/1979 | Heckenhauer et al. | 299/39.5 |
| 4,250,696 | A | 2/1981 | Hash | |

(Continued)

FOREIGN PATENT DOCUMENTS

| | | |
|---|---|---|
| CA | 2184950 | 8/1999 |
| CA | 2313849 | 4/2001 |

OTHER PUBLICATIONS

US Serial No. 9,410,099, Oct. 1, 1999, Donald Edwin Irving et al.

(Continued)

*Primary Examiner* — Abigail A Risic

(74) *Attorney, Agent, or Firm* — Wells St. John P.S.

(57) ABSTRACT

An apparatus for servicing roadways includes a frame configured to be secured to a prime mover. The apparatus further includes a grinding drum rotatably supported upon the frame. The apparatus still further includes a driving system supported upon the frame and configured to rotationally drive the grinding drum.

19 Claims, 28 Drawing Sheets

(56) References Cited

U.S. PATENT DOCUMENTS

| | | | | | |
|---|---|---|---|---|---|
| 4,256,344 | A * | 3/1981 | Hatcher | 299/39.4 |
| 4,325,580 | A * | 4/1982 | Swisher et al. | 299/39.8 |
| 4,786,111 | A * | 11/1988 | Yargici | 299/10 |
| 4,808,026 | A * | 2/1989 | Clarke et al. | 404/90 |
| 4,878,713 | A * | 11/1989 | Zanetis | 299/39.5 |
| 5,078,540 | A * | 1/1992 | Jakob et al. | 404/90 |
| 5,106,165 | A | 4/1992 | Lattman | |
| 5,203,615 | A * | 4/1993 | Zanetis et al. | 299/39.5 |
| 5,795,096 | A | 8/1998 | Culver | |
| 5,893,677 | A * | 4/1999 | Haehn et al. | 404/90 |
| 6,068,065 | A | 5/2000 | Mehew et al. | |
| 6,135,567 | A * | 10/2000 | Cochran | 299/39.6 |
| 6,149,342 | A * | 11/2000 | Phillips | 404/90 |
| 6,171,020 | B1 * | 1/2001 | Pikna et al. | 404/121 |
| 6,554,080 | B2 | 4/2003 | Horner | |
| 6,565,281 | B2 * | 5/2003 | Bruns et al. | 404/90 |
| 6,623,207 | B2 | 9/2003 | Grubba et al. | |
| 6,708,777 | B1 * | 3/2004 | Holmes | 172/684.5 |
| 6,887,013 | B2 * | 5/2005 | Ley et al. | 404/90 |
| 7,004,675 | B2 * | 2/2006 | Wayne | 404/91 |
| 7,331,636 | B2 * | 2/2008 | Troudt et al. | 299/39.6 |
| 2008/0129103 | A1 * | 6/2008 | Hall et al. | 299/39.2 |
| 2008/0292399 | A1 * | 11/2008 | Freeburn | 404/90 |
| 2009/0067927 | A1 * | 3/2009 | Stiffler et al. | 404/90 |
| 2009/0185859 | A1 * | 7/2009 | Haroldsen | 404/90 |
| 2009/0226259 | A1 * | 9/2009 | Comeau et al. | 404/122 |
| 2010/0008725 | A1 * | 1/2010 | Sampson | 404/128 |
| 2010/0074705 | A1 * | 3/2010 | Carr | 409/175 |
| 2012/0043401 | A1 * | 2/2012 | Heusinger et al. | 239/722 |

OTHER PUBLICATIONS

Broons "RockBuster" Brochure from web site www.broons.com/rockbuster/ downloaded Mar. 29, 2011, 2 pages.

IronWolf "Grader Mount Profiler" Broucher 2008, from Web site www.ironwolf.com, downloaded Mar. 29, 2011, 2 pages.

"Grader", Wikipedia, the free encyclopedia, from website http://en.wikipedia.org/wiki/Grader, downloaded Feb. 6, 2013, 2 pgs.

* cited by examiner 300
303
304
317
391
430
452
451
342
414
309
312
381
352
305
310
307
318
353
371
372
373
374
3
41
397
383
392
399
395
393
394

APPARATUSES FOR SERVICING ROADWAYS

CROSS REFERENCE TO RELATED APPLICATION

This application does not claim priority from any other application.

TECHNICAL FIELD

This invention relates to apparatuses and systems for servicing roadways, and methods for removing apparatuses and systems from prime movers.

BACKGROUND OF THE INVENTION

Substrate surfaces that support heavy loads, such as roadways, require frequent servicing including maintenance and repair to provide the roadways in a condition that is reasonably safe to use. For example, vehicle traffic and weather conditions continually cause irregularities in the roadway surfaces that effectively prevent the safe use of the roadways. Exemplary irregularities in roadway surfaces include depressions, sinkholes, potholes, ripples, surface breakaways and ridges of material. However, conventional apparatuses and systems for servicing roadways have numerous problems. For example, conventional apparatuses and systems are inefficient to operate, deficient in capabilities, expensive to purchase, expensive to operate, detrimental to the environment, unsafe to operate and unsafe for the public that comes in close proximity to the conventional apparatuses and systems during operation.

Accordingly, there is a need to provide apparatuses and systems for servicing substrate surfaces such as roadways that resolve the above-listed problems.

SUMMARY OF THE INVENTION

In one aspect of the invention, an apparatus for servicing roadways is disclosed and includes a frame configured to be secured to a prime mover. The apparatus further includes a grinding drum rotatably supported upon the frame. The apparatus still further includes a driving system supported upon the frame and configured to rotationally drive the grinding drum.

In another aspect of the invention, an auxiliary power system for servicing roadways is disclosed and includes a support surface removably secured to a prime mover with only a pin structure. The auxiliary power system further includes a power device upon the support surface, the power device configured to be operationally coupled to another apparatus in a power relationship.

In still another aspect of the invention, a method for removing an apparatus for servicing roadways from a prime mover is disclosed and includes providing a grinder apparatus as the apparatus and providing a road grader as the prime mover. The grinder apparatus is secured to a blade of the road grader. The method further includes disconnecting a power source from the grinder apparatus. The method still further includes removing a plurality of bolts securing the grinder apparatus to the blade.

In yet another aspect of the invention, a method for removing a system for servicing roadways from a prime mover is disclosed and includes providing an auxiliary power system as the system and providing a road grader as the prime mover. The auxiliary power system is secured to the road grader. The method further includes removing at least one pin extending into the auxiliary power system and into the road grader.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Figures 1, 2, 3:
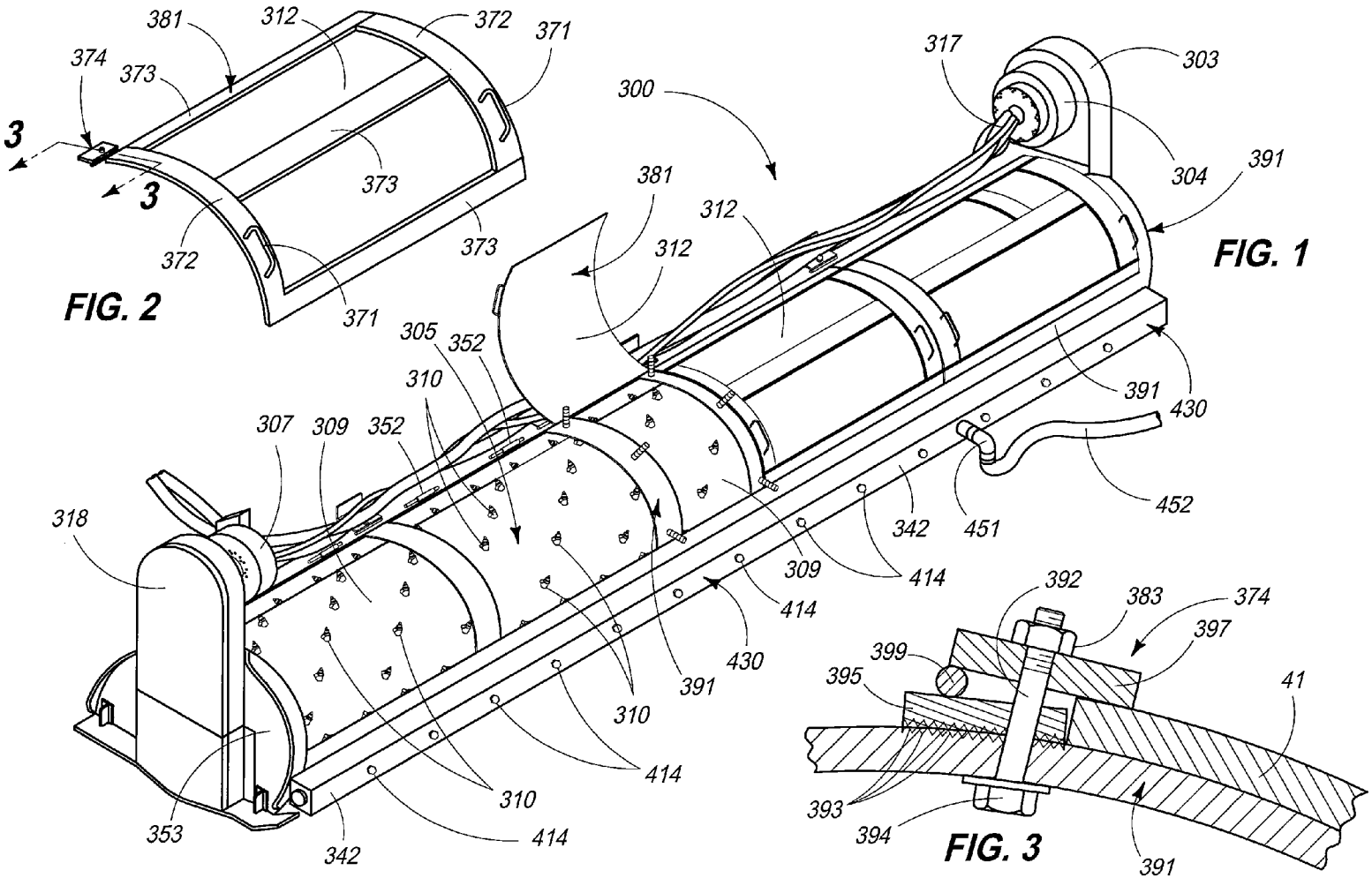
FIG. 1 is a perspective view of an exemplary grinder apparatus according to one of various embodiments of the invention.
FIG. 2 is a perspective view of an exemplary door for the grinder apparatus of FIG. 1 according to one of various embodiments of the invention.
FIG. 3 is a fragmentary side sectional view of an exemplary bolt or clamp structure according to one of various embodiments of the invention.

Referring to FIG. 1, various exemplary embodiments of the invention are described and illustrated, and include inventive apparatuses and systems for servicing (including maintaining and repairing) substrates and substrate surfaces that support heavy loads such as roads and roadways. According to one exemplary embodiment of the invention, an inventive apparatus is referred to as a grinder apparatus (or grinding apparatus) 300 and can be considered an apparatus for servicing roadways. The exemplary grinder apparatus 300 will be self-propelled or propelled by a separate vehicle or prime mover such as a heavy-duty truck, tractor, road grader or other self-propelled vehicles. Accordingly, for one of various embodiments of the invention, the exemplary grinder apparatus 300 is self-propelled, and alternatively, pulled or pushed by another vehicle. If the exemplary grinder apparatus 300 is configured to be pushed or pulled, it should be understood that the grinder apparatus 300 is configured to be attached or secured to one or more of the previously listed separate vehicles.

Still referring to FIG. 1, the grinder apparatus 300 according to one exemplary embodiment includes a frame structure 391 configured as a skeleton frame work or cover surrounding and supporting a grinding drum or grinding head (grinding drum head) (hereinafter routinely referred to as a drum) 305. An exemplary drum 305 includes a cylindrical outermost surface 309 and is rotationally (rotatably) supported upon opposing side plates 353 (only one shown in this figure) of frame structure 301. For one exemplary embodiment of the invention, the exemplary cylindrical outermost surface 309 of drum 305 is bare (without structure secured to or extending there from). For another exemplary embodiment of the invention, the exemplary drum 305 includes structures or projections extending from, and removably secured to, cylindrical outermost surface 309, such as teeth described subsequently.

Still referring to FIG. 1, an exemplary length dimension for an exemplary drum 305 of grinder apparatus 300 according to various embodiments of the invention includes a dimension range of from about 5 feet to about 25 feet. Furthermore, an exemplary length dimension for an exemplary drum 305 includes any dimension between 5 feet and 25 feet having incremental differences of one inch. Another exemplary length dimension for an exemplary drum 305 includes a range of from about 8 feet to about 16 feet, and includes any dimension between 8 feet and 16 feet of incremental differences of one inch. An exemplary length for an exemplary drum 305 of grinder apparatus 300 according to one embodiment of the invention includes about 12 feet and 6 inches. An exemplary outermost diameter dimension for an exemplary drum 305 of grinder apparatus 300 according to various embodiments of the invention includes a dimensional range of about 6 inches to about 50 inches and includes any dimension between 6 inches and 50 inches with an incremental difference of a half (½) (0.5) inch. Still further, an exemplary drum 305 of grinder apparatus 300 is a tubular structure having a thickness dimension ranging from about a half (½) inch to about two inches and includes any dimension between a half (½) inch and two inches with an incremental difference of about 1/16 inch.

Still referring to FIG. 1, exemplary structures extending from and/or secured to the cylindrical outermost surface 309 of drum 305 include teeth 310. For one exemplary embodiment, teeth 310 are secured to drum 305 via a weld. For another exemplary embodiment, teeth 310 are secured to drum 305 via attachment devices such as bolts or adhesives compatible for metals. Exemplary materials for frame structure 391 include flexible materials and/or inflexible materials, for example, plastics, iron, steel, other metal materials, fiberglass, polyethylene and composites of plastic, metals or both. Exemplary materials for drum 305 include flexible materials and/or inflexible materials, for example, plastics, iron, steel, other metal materials, fiberglass, polyethylene and composites of plastic, metals or both.

Still referring to FIG. 1, and according to one embodiment of the invention, the grinding apparatus 300 is not configured with a driving system secured to frame structure 391 to rotationally drive drum 305. For this embodiment, a remote or auxiliary driving system is utilized to rotationally drive drum 305. In one embodiment, the remote or auxiliary driving system is provided by the prime mover such as the road grader and includes a driving system powered by a hydraulic system supported upon the road grader. It should be understood that there will be a power source coupled to the grinder apparatus 300 to drive drum 305.

Still referring to FIG. 1, for another embodiment of the invention, the grinding apparatus 300 is configured with at least one driving system secured to frame structure 391 to rotationally drive drum 305. For still another embodiment of the invention, the grinding apparatus 300 is configured with at least two driving systems secured to frame structure 391 to rotationally drive drum 305. It should be understood that there will be a power source coupled to the grinder apparatus 300 and to the one or more driving systems which ultimately drive drum 305. Any one of the exemplary driving systems can be powered by an auxiliary power system (power source) not provided by the prime mover such as the road grader. Alternatively, any one of the exemplary driving systems can be powered by the prime mover such as the road grader (power source from road grader).

Still referring to FIG. 1, exemplary driving systems include hydraulic systems, electrical motor systems and combustible engine systems. If the exemplary grinding apparatus 300 includes two driving systems, various combinations of driving systems is possible. For the exemplary embodiment shown in FIG. 1, the grinding apparatus 300 includes a driving system having two hydraulic motors 304 and 307 dedicated solely to rotationally drive drum 305 and supported upon frame structure 391 at opposite ends.

Still referring to FIG. 1, an exemplary driving system for grinder apparatus 300 to drive drum 305 discussed previously will include wiring and/or tubing 317. For example, if an exemplary driving system is an electric motor, 317 will represent at least electrical wiring to deliver current to the electric motor. If an exemplary driving system is a combustion engine, 317 may represent wiring and tubing for electrical current and fuel, respectively. However, it should be understood with regard to a combustion engine, a fuel tank could be supported upon grinder apparatus to negate the need for fuel tubing. Furthermore, and still with regard to a combustion engine, a battery device could be supported upon grinder apparatus to negate the need for electrical wiring. In the embodiment shown, reference numeral 317 represents at least hydraulic tubing to provide hydraulic fluid to hydraulic motors 304 and 307. Respective hydraulic motors 304 and 307 extend inwardly over a portion of the frame structure 391.

Referring to FIGS. 1 and 2, the exemplary grinder apparatus 300 includes at least one or more doors 381 pivotably secured to frame structure 391 on hinges 352. Accordingly, doors 381 can be pivoted upon hinges 352 between a closed position and an opened position. In one embodiment of the invention, doors 381 can be selectively removed from hinges 352 and frame structure 391. Exemplary embodiments of doors 381 include two laterally-spaced side supports 372 which are configured as arcs (curved or bow shaped) and three crossbars 373 spaced from each other and extending between the two laterally-spaced side supports 372. Each side support 372 includes at least one handle 371. Each door 381 includes a cover 312 secured to an underside one or more of side supports 372 and crossbars 373. Exemplary materials for covers 312 include flexible materials and/or inflexible materials, for example, rubber, foam material, plastics, cloth, steel, iron, other metal materials, ceramics, wood, fiberglass, polyethylene and composites of plastics, metals, cloth and any combination.

Still referring to FIG. 1, it should be understood that one exemplary embodiment of the invention includes a grinder apparatus 300 being configured without a fluid spray system. For yet another exemplary embodiment, the exemplary grinder apparatus 300 includes an inventive fluid spray system (fluid flow system) 430. The inventive fluid spray system 430 according to one embodiment includes a spray bar (fluid pressure bar) 432 secured to frame structure 391 of grinder apparatus 300. An exemplary spray bar 432 according to an embodiment of the invention is configured to receive a fluid and maintain the fluid under pressurized conditions. For one embodiment of the invention, an outermost wall surface of the spray bar 432 includes a plurality of nuts 414. Exemplary nuts 414 are similar to nuts 458 described subsequently with respect to FIG. 19 and can be characterized as spray valve adjustment nuts. That is, an exemplary spray pin (not shown) has one end threadingly engaging one of the nuts 414 wherein the spray pin extends into the spray bar 432. An opposite end of the spray pin (not shown) acts as a valve to open and close fluid flow of an exemplary spray device (or fluid flow device) (discussed more thoroughly subsequently and not shown here) to permit, and alternatively impede, fluid flow through the spray device directed to drum 305. The threading cooperation between nut 414 and spray pin provides the capability of adjusting the spray pin between the closed and opened positions to permit and alternatively impede fluid flow.

It should be further understood that some exemplary embodiments of the invention would have inventive fluid spray system 430 with the structure of the nuts 414 and the spray pin (not shown). The exemplary fluid spray system 430 further includes an elbow 451 secured to and in fluid communication with the spray bar 432 and a first end of a fluid hose 452 connected to elbow 451 wherein another end of fluid hose 452 is not shown and is connected to a fluid source described more thoroughly subsequently.

Referring to FIG. 3, an exemplary attachment structure 374 to fasten grinder apparatus 300 to another structure (i.e., a self-propelled vehicle) is illustrated according to one embodiment of the invention. An exemplary self-propelled vehicle includes a road grader (motor grader or grader); more thoroughly discussed subsequently, wherein a portion of the road grader's blade, represented as 41, is illustrated in FIG. 3. An exemplary attachment device 374 is configured as a clamp and includes a bolt 392 having a head portion 394, a mating structure 397 slidingly engages bolt 392, and a nut 383 threadingly engages bolt 392 over and against mating structure 397. An exemplary mating structure 397 includes a contact structure 399. The frame structure 391 of grinding apparatus 300 includes a leveler 395 secured to frame structure 391 via a weld 393. Aligned bores or openings (not shown) through frame structure 391 and leveler 395 receive bolt 392 to allow contact structure 399 to rest against leveler 395. It should be understood that a plurality of attachment structures 374 and levelers 395, as needed, can be strategically provided to frame structure 391 of grinding apparatus 300.

Still referring to FIG. 3, an exemplary method for securing grinder apparatus 300 to the exemplary road grader includes positioning a portion of blade 41 adjacent leveler 395 between mating structure 397 and frame structure 391. After the positioning, threading (tightening) nut 383 onto bolt 392 applies pressure to mating structure 397 against blade 41 which compresses blade 41 against frame structure 391 establishing a secure connection between grinder apparatus 300 and the road grader through blade 41.

Figure 4:
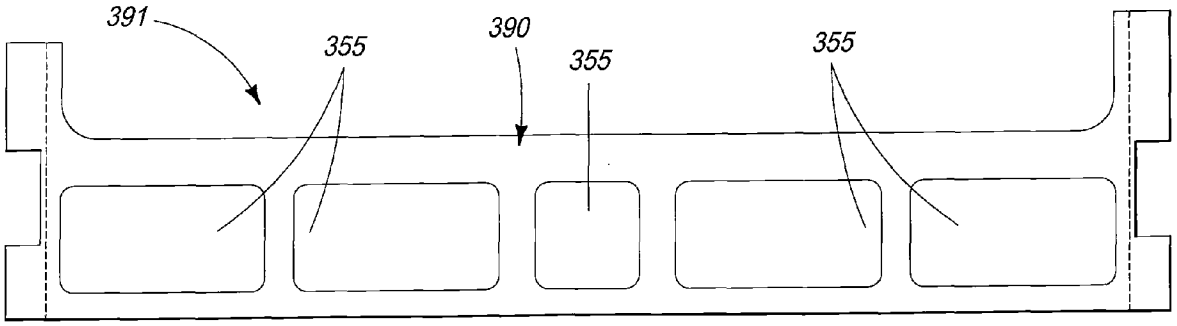
FIG. 4 is a top view of a portion of an exemplary frame structure for the grinder apparatus of FIG. 1 according to one of various embodiments of the invention.
Figure 5:
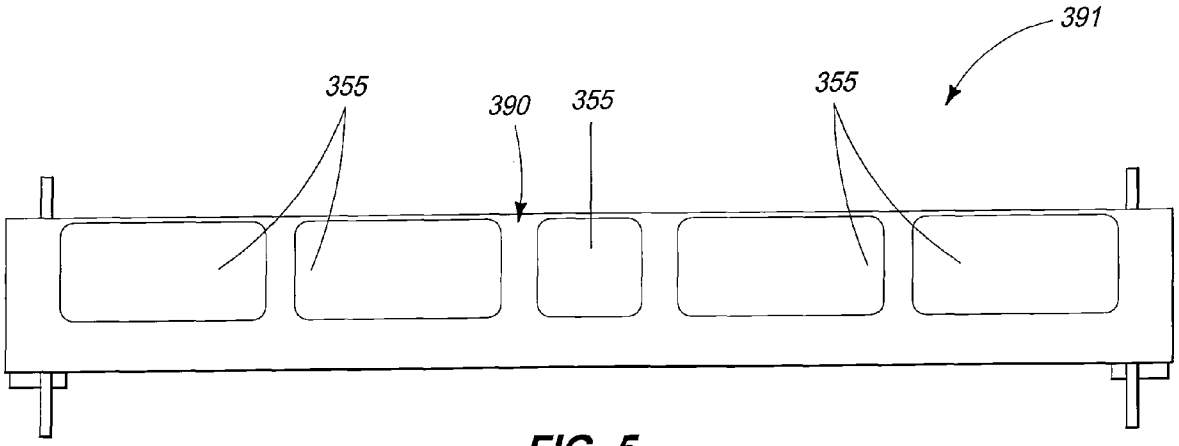
FIG. 5 is a front view of a portion of the exemplary frame structure of FIG. 4 according to one of various embodiments of the invention.
Figure 6:
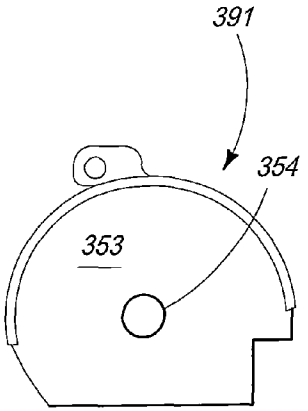
FIG. 6 is an end view of the exemplary frame structure of FIG. 4 according to one of various embodiments of the invention.

Referring to FIGS. 4-6, components of an exemplary frame structure 391 are illustrated and include a main component 390 (FIGS. 4-5) and two (only one shown) separate and discrete side plates 353. It should be understood that side plates 353 will be secured to opposite ends of main component 390. Each side plate 353 has an opening 354 to receive a drive shaft 344 for drum 305 discussed relative to FIG. 7. The main component 390 includes a plurality of openings 355 in frame structure 391 for which doors 381 (previously discussed) provide cover (protection) for drum 305 (doors 381 in the closed position). Alternatively doors 381 can provide for selective uncovering of openings 355 (doors 381 in the opened position) to allow access to drum 305 of grinder apparatus 300. Any number of openings 355 can exist in frame structure 391 and have any geometric configuration.

Figure 7:
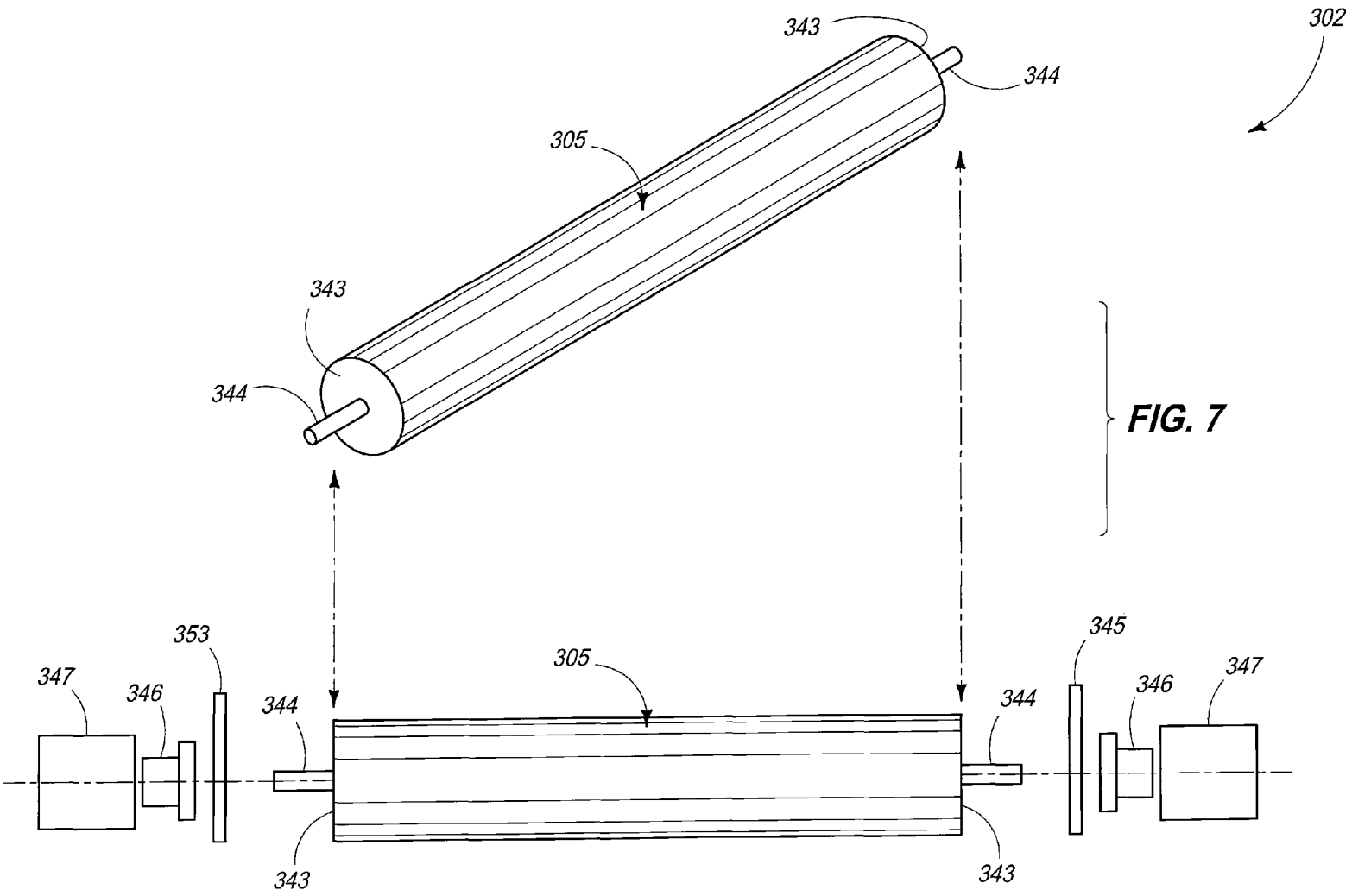
FIG. 7 is a perspective and a side view of an exemplary grinding drum or head for the grinder apparatus of FIG. 1 according to one of various embodiments of the invention.

Referring to FIG. 7, an exemplary drum assembly 302 is illustrated according to one embodiment of the invention. The exemplary drum assembly 302 includes an exemplary drum 305 as described previously which is generally cylindrical. This embodiment of drum 305 includes the outermost surface 309 as having no teeth 310. However, as previously stated, other embodiments of the invention have drum 305 including teeth 310. An exemplary drum 305 includes a drive shaft 344 extending from opposite ends, or end plates 343. One exemplary embodiment of the invention includes drum 305 being hollow. An alternative exemplary embodiment of the invention includes drum 305 being solid. If drum 305 is hollow, an embodiment of drum 305 can include a covered opening (not shown) to allow access to an interior of drum 305 wherein material could be provided through the opening to the interior to increase the weight of drum 305 (and possibly change the dynamics and characteristics of drum 305 during rotation). For example, a fluid such as water may be added to the interior of drum 305.

Still referring to FIG. 7, an exemplary drum assembly 302 includes, for receipt on drive shaft 344 at each end of drum 305, a support plate 345, a support bearing 346 and a rotational drive mechanism 347.

Figures 8, 9:
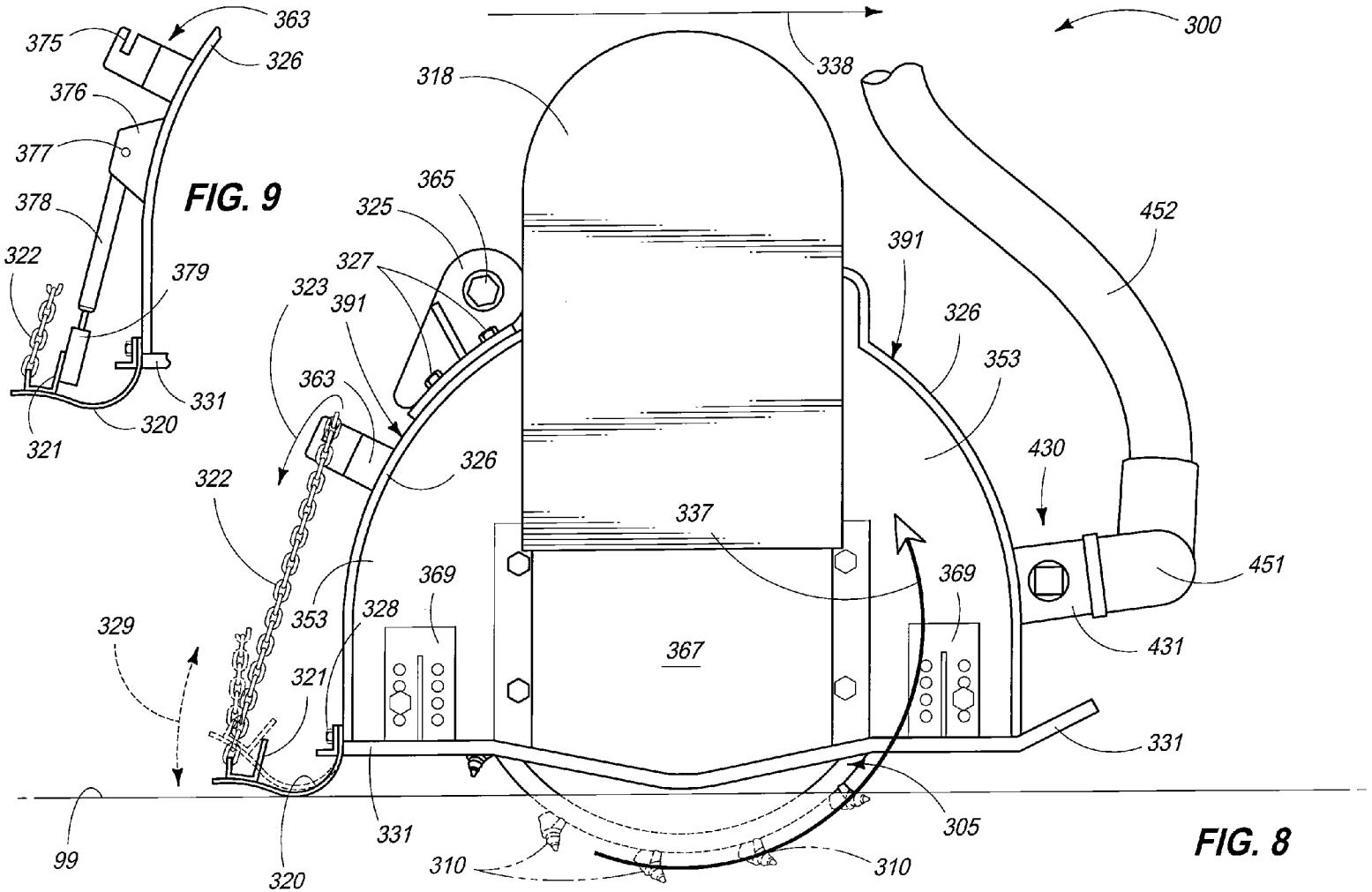
FIG. 8 is an end view of the exemplary grinder apparatus of FIG. 1 according to one of various embodiments of the invention.
FIG. 9 is a side view of another exemplary embodiment of a strike-off bar according to one of various embodiments of the invention.

Referring to FIG. 8, an exemplary end view of grinder apparatus 300 is shown over an exemplary upper surface of a substrate (or substrate surface 99) such as a roadway. It should be understood that throughout this document, any reference to substrate or substrate surface refers to a various number of substrates such as artificial substrates, man-made substrates and even natural substrates and include roads, roadways, areas surrounding or in roadways such as shoulders, ditches, embankments, medians and surfaces covered with ice including roads and lakes.

Still referring to FIG. 8, an exemplary embodiment of the invention includes the drum 305 of grinder apparatus 300 to rotate, from this view, in a counterclockwise direction as shown by direction arrow 337 while the entire grinder apparatus 300 travels in direction 338 from left to right. As the drum 305 rotates counterclockwise, teeth 310 grind and churn the upper surface (of the substrate) 99 of roadway and throws the ground-up substrate over and around drum 305 wherein a portion of the drum 305 extends a distance elevationally below the upper surface 99 of the roadway. This side view of frame structure 391 illustrates a side plate gusset 326 extending substantially in a half-circle configuration having opposite ends of the half-circle configuration terminating at a skid plate 331 portion of frame structure 391 of grinder apparatus 300. The exemplary side plate gusset 326 is a rolled formed bar that reinforces side plate 353 and is used to be attached to the other structure mentioned previously such as the blade (moldboard) 41 of a road grader.

Still referring to FIG. 8, the exemplary grinder apparatus 300 includes an upper belt cover 318 elevationally above a lower belt cover 367 and both protect structure (for example, belts and flywheels) beneath the covers from the environment and prevent injury. A pair of brackets 369 secure skid plate 331 to side plate 353. An ear bracket 325 having bolt 365 is provided as a primary bracket to couple or hang side plates 353 (only one shown here) from the other structure discussed throughout this document such as the blade (moldboard) 41 of a road grader. The exemplar ear bracket 325 is secured to a rear facing portion of the side plate gusset 326 by bolts 327.

Referring to FIGS. 8 and 9, an exemplary embodiment of the grinder apparatus 300 includes a leveling bar or strike-off bar 320. An exemplary strike-off bar 320 levels substrates 99 such as the ground and/or roadway surface materials and reduces "blading" of such substrates 99 that routinely occurs during road grading (repair and maintenance) with conventional road graders. One end of strike-off bar 320 is secured to side plate gusset 326 and/or skid plate 331 with bolt 328. An opposite end of strike-off bar 320 includes a bracket 321 for receiving a link of an adjustment chain 322 to secure the adjustment chain 322 to the strike-off bar 320. An opposite end of adjustment chain 322 is received over an adjustment bracket (or chain bracket) 363 which extends rearward from the side plate gusset 326. An exemplary adjustment bracket 363 includes a groove or slot 375 (see FIG. 9) which is configured to receive a link of adjustment chain 322 wherein the link must be oriented on its side to fit in the groove or slot 375. In this fashion, by selecting different links of adjustment chain 322 to be placed sideways into slot 375 of adjustment bracket 363, the length of adjustment chain 322 between adjustment bracket 363 and strike-off bar 320 is selectively shortened or lengthened. Correspondingly, the strike-off bar 320 is selectively adjusted upwardly or downwardly relative substrate 99 along direction arrow 329.

Still referring to FIGS. 8 and 9, exemplary materials for strike-off bar 320 include semi-flexible materials and/or flexible materials, for example, plastics, malleable metals, rubbers, fiberglasses, polyethylenes and composite combinations of plastic, rubber, metals or all three. For one exemplary embodiment, strike-off bar 320 is configured to be inherently biased downwardly toward substrate 99 to apply pressure to substrate 99 thereby smoothing/leveling the substrate 99. One exemplary material for strike-off bar 320 is steel-belted rubber which is biased in a specific direction.

Alternatively and referring to FIG. 9, another exemplary embodiment of a strike-off bar 320 includes additional structure to provide a biasing force downwardly. Such additional structure includes a piston structure 378 that is secured at one end to bracket 321 and an opposite end is pivotedly secured to another bracket 376 extending from side plate gusset 326. An exemplary piston structure 378 biases strike-off bar 320 toward substrate 99.

Figure 10:
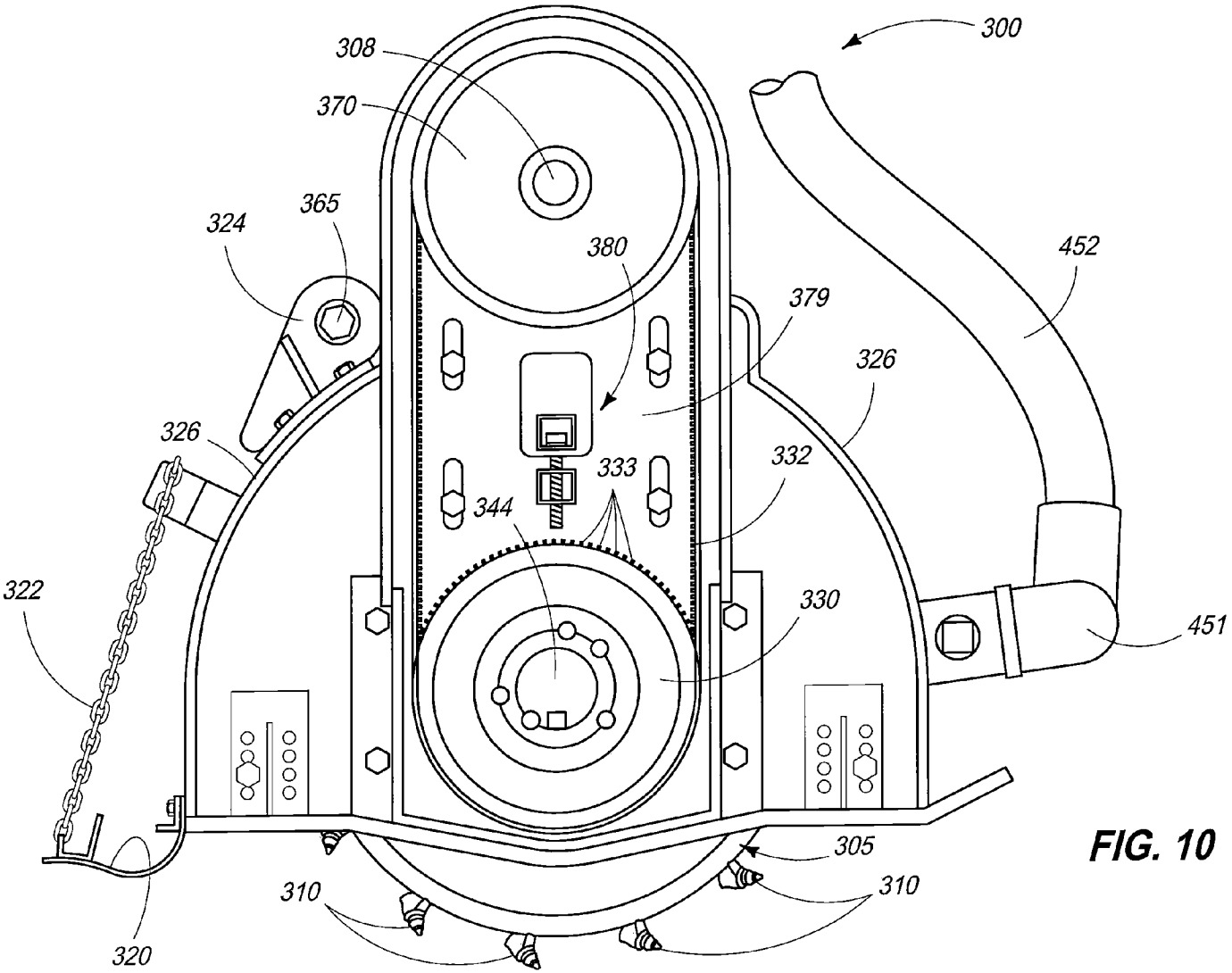
FIG. 10 is the end view of FIG. 8 with covers of the grinder apparatus removed to illustrate additional structure according to one of various embodiments of the invention.

Referring to FIG. 10, the end view of the exemplary grinder apparatus 300 is illustrated with the upper belt cover 318 and the lower belt cover 367 removed. It should be understood that for one exemplary embodiment, the opposite end view of grinder apparatus 300 would illustrate the same structure discussed below. An end of an exemplary motor shaft 308 from motor 307 (shown in FIG. 1) is exposed and coupled to an upper drive sprocket 370. Upper drive sprocket 370 has sprocket teeth or cogs (not shown) that engages drive belt 332. Drive belt 332 additionally engages sprocket teeth or cogs 333 of lower drive sprocket 330. Lower drive sprocket 330 is coupled to drive shaft 344 of drum 305 (see FIG. 7). A sliding drive plate extends between respective upper and lower drive sprockets 370 and 330 and with plate adjustment device 380, provides the capability to adjust the tension in drive belt 332. With this configuration, rotational power is transmitted from motor 307 (shown in FIG. 1) ultimately to rotate drum 305. That is, motor 307 rotates motor shaft 308 which rotates upper drive sprocket 370 which moves drive belt 332 which rotates lower drive sprocket 370 which rotates drive shaft 344 to ultimately rotate drum 305.

Figure 11:
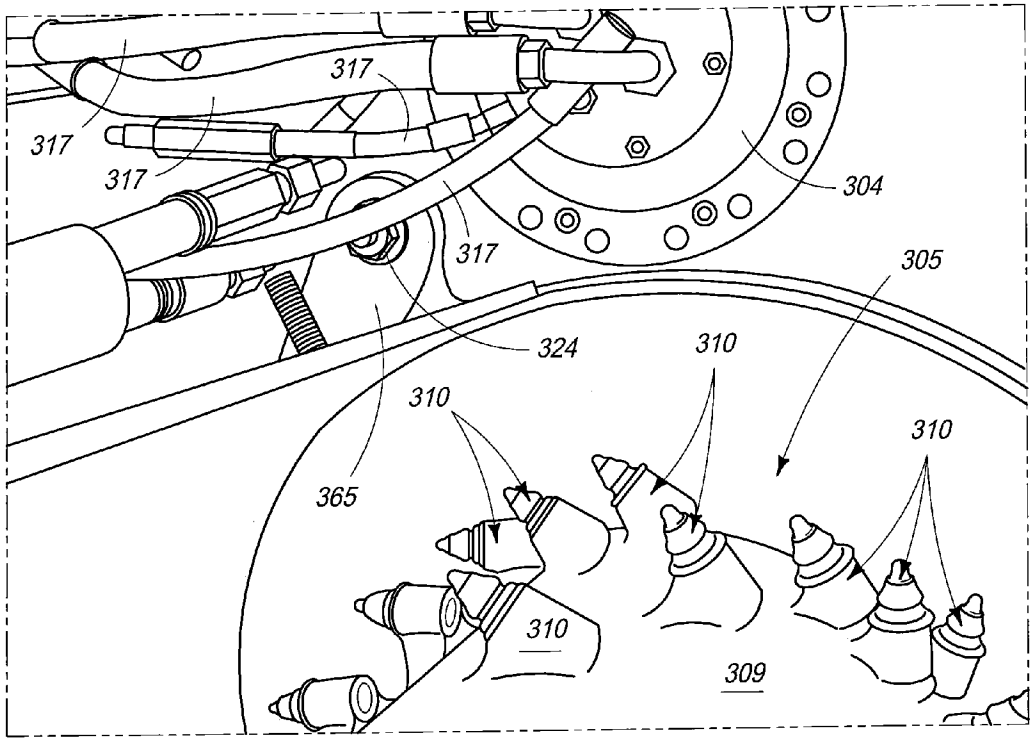
FIG. 11 is a fragmentary perspective view of the inventive grinder apparatus of FIG. 1 more thoroughly illustrating exemplary teeth structures according to one of various embodiments of the invention.
Figure 12:
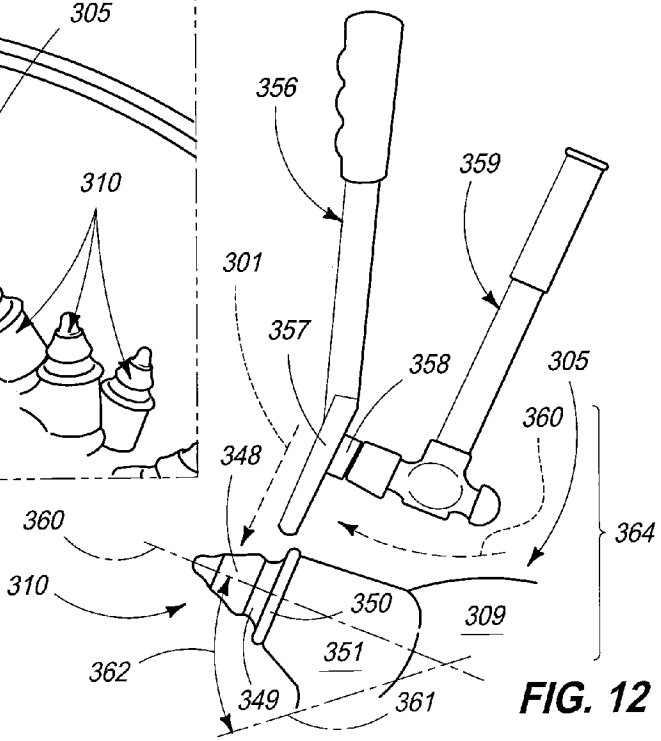
FIG. 12 is a perspective view of an exemplary method of removing a portion of the teeth structures of FIG. 11 according to one of various embodiments of the invention.

Referring to FIGS. 11 and 12, an exemplary grinder apparatus 300 includes teeth 310 according to one embodiment of the invention that are configured to be replaced. An exemplary tooth 310 includes a base 351 secured to drum 305, a washer 350 on the base 351, and a conical tip 348 extending through the washer 350 and into the base 351. An exemplary conical tip 348 according to one embodiment of the invention includes a circumferential groove 349 having a diameter less than the washer 350 and less than the largest diameter portion of the conical tip 348 which is adjacent to the circumferential groove 349. In one embodiment, the washer 350 is held in place without any securement to the base 351 or to the conical tip 348 and provides wear protection to the base 351. Alternatively, washer 350 is secured to either one, or both, of the conical tip 348 and base 351. An exemplary material for base 351 includes any metal materials and metal alloys such as steel and iron, and as stated previously, may be secured to drum 305 with a weld. An exemplary material for conical tip 348 includes hard metal materials such carbide materials, tungsten, tungsten carbides and diamond. Exemplary teeth 310 are manufactured by, and be purchased from, Sandvik Mining and Construction headquartered in Sandviken, Sweden.

Referring to FIG. 12, an exemplary method for replacing at least a portion of teeth 310 is described with several structures being shown in combination and referenced as 364. A first method step includes obtaining a hammer 359 and a wrench 356. An exemplary wrench 356 includes a forked head portion 357 at one end having dimensions to fit snugly over the circumferential groove 349 of each tooth 310. The wrench 356 includes a contact knob 358 extending from one side above the head portion 357. A second method step includes moving wrench 356 along direction 301 to provide the forked head portion 357 over the circumferential groove 349 of tooth 310. While the wrench 356 is positioned on tooth 310, a third method step includes striking the contact knob 358 of the wrench 356 with the hammer 359 to drive the conical tip 348 from the base 351 of tooth 310. A fourth method step includes aligning another different (new) conical tip 348 over the washer 350 and base 351 of the tooth 310 and driving the different conical tip 348 through the washer 350 into the base 351 establishing a new tooth 310.

It should be understood that teeth 310 can be provided on drum 305 in any configuration, in any pattern, at any angle relative the surface of a drum 305, and in any number over drum 305 according to various embodiments of the invention for grinder apparatus 300. An exemplary goal for the configuration, pattern and number is to avoid or diminish the vibration of the drum as the teeth grind and/or churn the substrate surface. One exemplary goal is to have only one tooth grinding/churning (or digging) in an exemplary substrate at a given time frame that approximates a millisecond. An exemplary pattern includes one row of teeth 310 across or along a length of drum 305, or across only a portion of the length, or a plurality of rows along the length of drum 305 and spaced at any distance from each other along the circumference of drum 305. Alternatively, an exemplary pattern includes one column of teeth 310 across or along a circumference of drum 305, or across only a portion of the circumference, or a plurality of columns along the circumference of drum 305 and spaced at any distance from each other along the length of drum 305. Other exemplary patterns include the teeth 310 being over only a central portion of drum 305, or over one, or both, of side portions of drum 305. Still further, exemplary patterns include the teeth 310 forming geometrical configurations over drum 305 such as rectangles, squares, diamonds, hexagons, etc.

Still further, other exemplary embodiments of the inventions include teeth 310 configured on drum 305 for grinder apparatus 300 with additional ultimate goals such as: to move and position grounded-up portions of an exemplary substrate in a specific position relative drum 305 during the grinding operation; and to provide specific cutting depths into an exemplary substrate during the grinding operation. For example, exemplary patterns of teeth 310 can facilitate these goals, an exemplary number of teeth 310 provided on drum 305 can facilitate these goals, and exemplary angles 362 for which teeth 310 extend over/relative surface 309 of drum 305 can facilitate these goals. For example, exemplary patterns of teeth 310 can be configured on drum 305 to leave grounded portions of a substrate placed at one side, or the center, of drum 305.

Still further and still referring to FIG. 12, exemplary angles 362 for which teeth 310 extend over or relative surface 309 of drum 305 can facilitate these goals. The exemplary angles 362 are measured between an imaginary line 360 through the conical tip 348 and an imaginary line 361 along the surface 309 of drum 305 proximate the base 351 of teeth 310. Exemplary angles of teeth 310 according to various embodiments of the invention include 10°, 20°, 30°, 40°, 50°, 60°, 70° and 80°, and include any one angle of teeth 310 between 10°-80° having single degree incremental differences, for example, 11°, 12°, 13°, 14°, 15°- . . . 79°. One exemplary angle 362 according to one of various embodiments of the invention includes 55°. Furthermore, an exemplary number of teeth 310 according to various embodiments of the invention over drum 305 can facilitate the above-listed goals. An exemplary number of teeth 310 include a range of from about 10 teeth to about 450 teeth, and include any one number of teeth between 10 teeth to 400 teeth having single digit incremental differences, for example, 11 teeth, 12 teeth, 13 teeth, 14 teeth, 15 teeth- . . . 449 teeth. One exemplary number of teeth 310 according to one of various embodiments of the invention includes three hundred and twenty five (325) teeth 310.

It should be understood that exemplary drum 305 of inventive grinder apparatus 300 has rotational (revolution) speed ranging from about one revolution per minute (r.p.m.) to about 450 revolutions per minute. An exemplary number of revolutions per minute for drum 305 include any one number of revolutions per minute between 1 and 450 having single digit incremental differences, for example, 2 revolutions per minute, 3 revolutions per minute, 4 revolutions per minute, 5 revolutions per minute- . . . 449 revolutions per minute.

Figure 13:
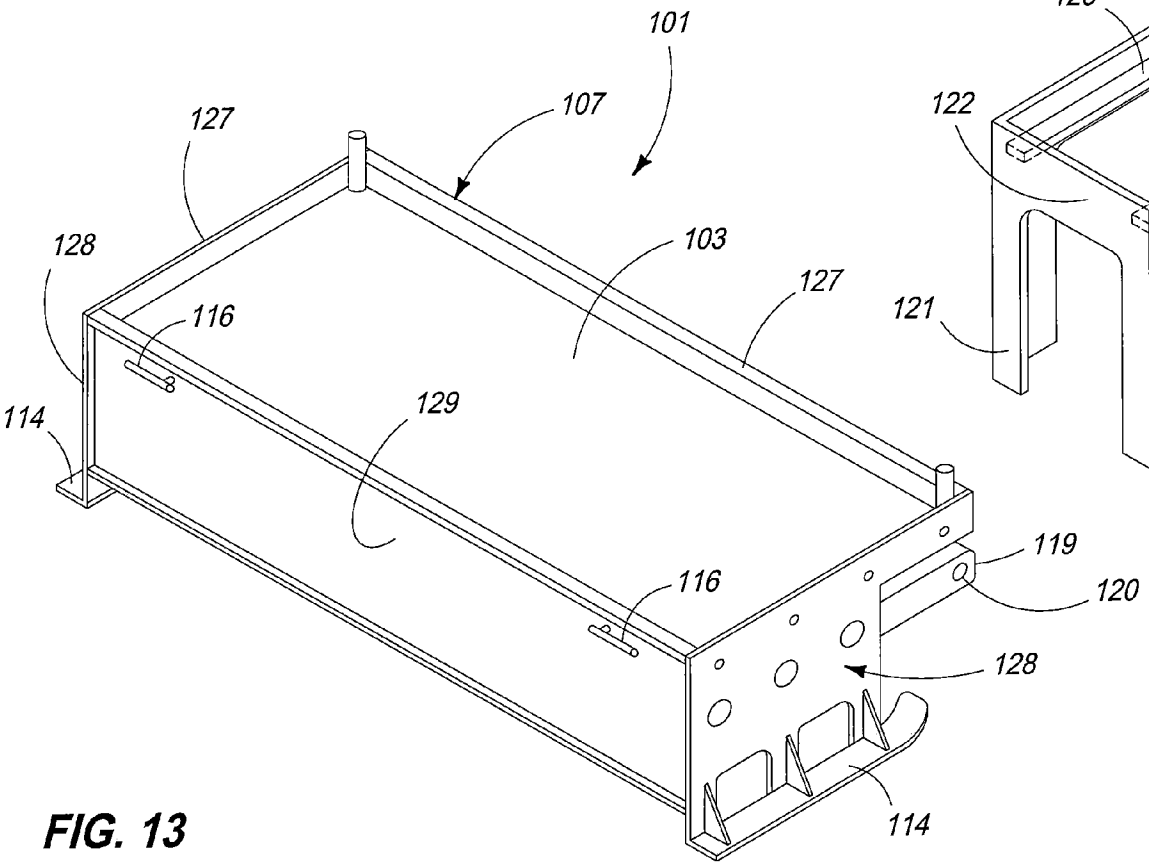
FIG. 13 is a perspective view of an exemplary component of an exemplary power system according to one of various embodiments of the invention.

Referring to FIG. 13, another one of various exemplary embodiments of the invention representing an inventive apparatus for servicing (maintaining and repairing) roads/roadways is described and illustrated. According to one exemplary embodiment of the invention, this inventive apparatus is referred to as an auxiliary power system or auxiliary power unit. One exemplary embodiment of the invention includes the power system being a hydraulic power system or unit (HPU) (see power system 100 in FIG. 16) and is applicable for any self-propelled vehicles as an auxiliary or extra power system or unit. That is, an exemplary self-propelled vehicle such as a road grader described below will already have a primary power system to at least drive wheels to move the road grader and may be configured to drive other components of the road grader. However, the primary power system can be insufficient to power new and additional apparatuses configured for the vehicle. Consequently, an inventive auxiliary power system is needed that can be easily and cheaply operatively coupled with the vehicle to power and operate the new apparatuses.

Still referring to FIG. 1, an exemplary embodiment of the invention includes hydraulic power system 100 which can be considered an apparatus for servicing roadways (or auxiliary power system for servicing roadways). The exemplary hydraulic power system 100 has separate components coupled together. For example, one component includes a tank housing 101 having a frame 107 that includes a support surface 103 as an uppermost surface which is surrounded by a railing 127. Frame 107 further includes a rear door 129 over a rear end to receive a fuel tank and extends between a pair of opposite sidewalls 128. Lowermost portion of each sidewall 128 includes a laterally extending support shoe 114 to support an exemplary hydraulic power system 100 to stand alone upon a substrate just as a ground. An exemplary rear door 129 includes handles 116 for opening (and closing) to provide access to the enclosed fuel tank. A pair of support arms 119 (only one shown) extend forward from a front wall of frame 107 adjacent respective sidewalls 128 and beneath a portion of support surface 103. Each support arm 119 has an opening 120 for receiving a pin (shown in subsequent figures) to secure/attach power system 100 to the self-propelled vehicle such as a road grader.

Figure 14:
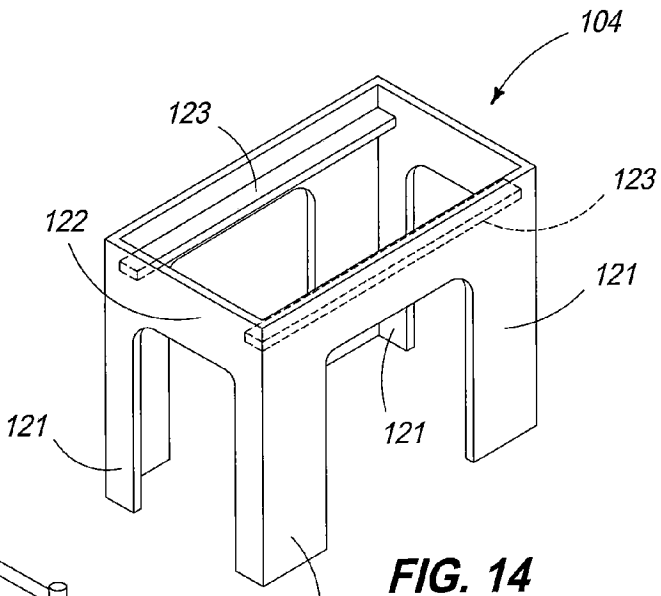
FIG. 14 is a perspective view of another exemplary component of the exemplary power system according to one of various embodiments of the invention.

Referring to FIG. 14, another component for another one of various exemplary embodiments of the invention includes a support stand 104. An exemplary support stand 104 includes four legs 121 oriented in a rectangular configuration and connected to each other via integral extensions 122 establishing an upper rectangular opening. A pair of shelves 123 extends inwardly from one pair of opposite facing inside walls of integral extensions 122.

Figure 15:
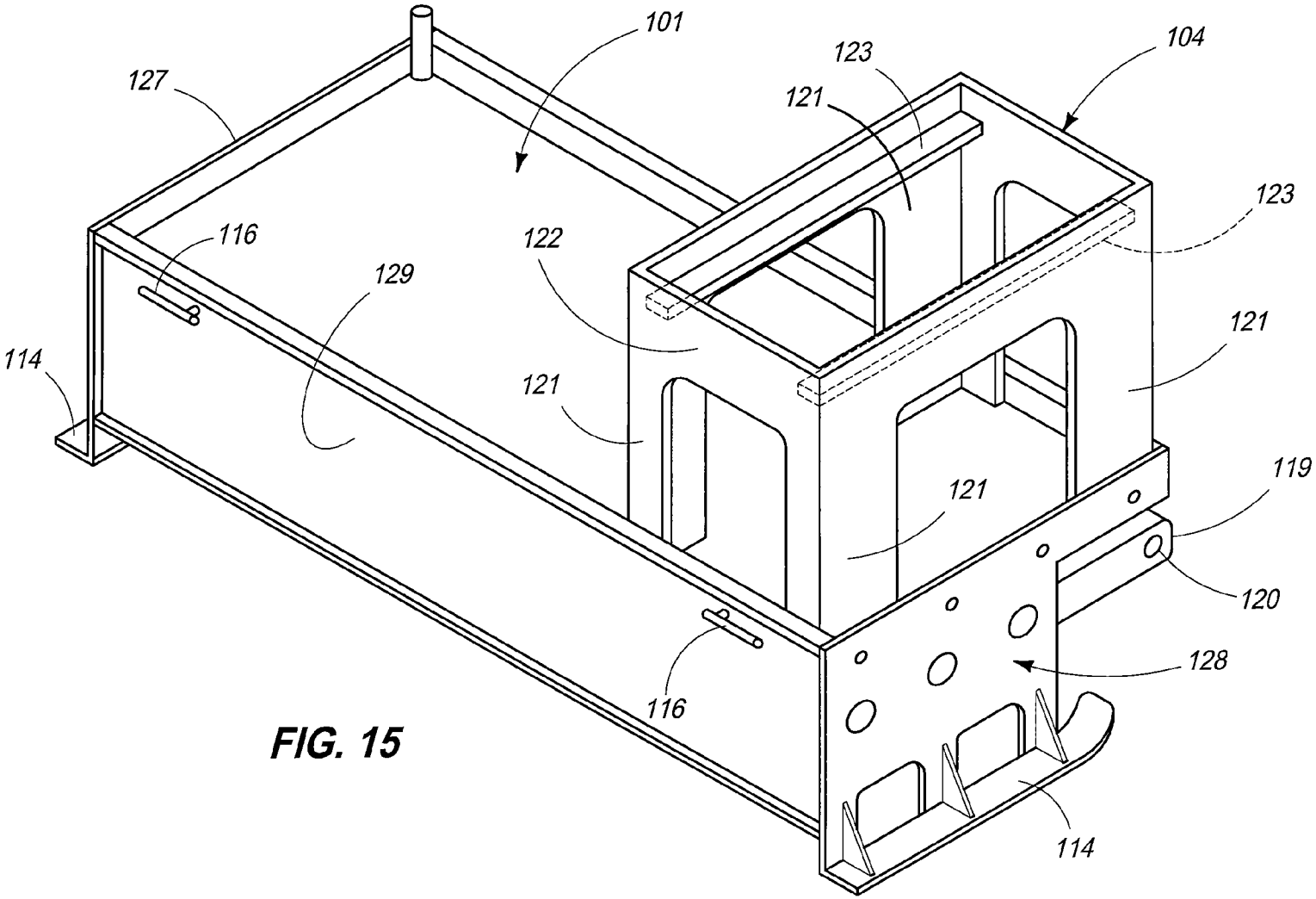
FIG. 15 is a perspective view of the exemplary components disclosed in FIGS. 13 and 14 combined according to one of various embodiments of the invention.

Referring to FIG. 15, support stand 104 is shown positioned upon an end of support surface 103 of frame 107 of tank housing 101.

Figure 16:
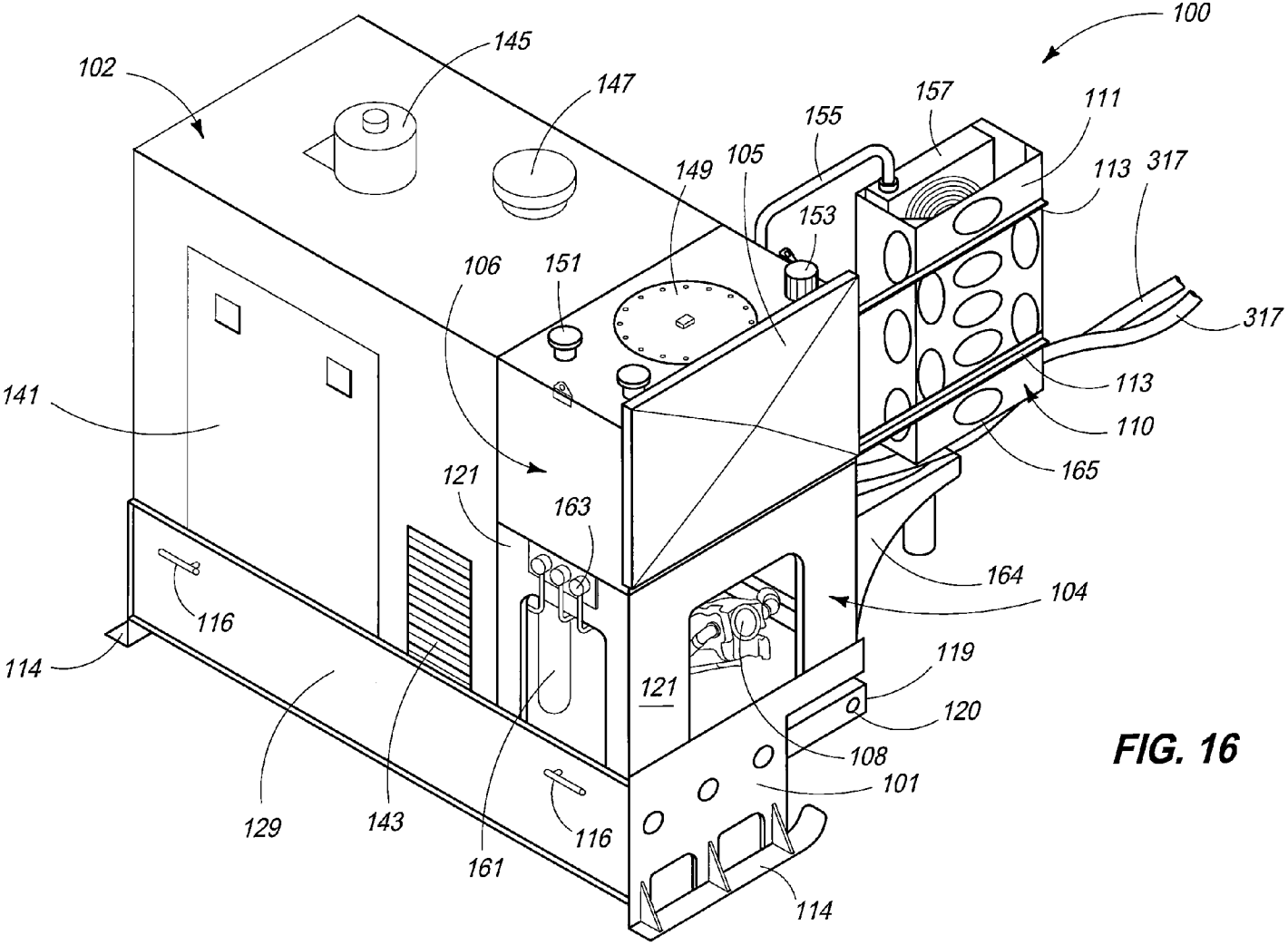
FIG. 16 is a perspective view of the exemplary power system according to one of various embodiments of the invention.

Referring to FIG. 16, the exemplary embodiment of auxiliary power system 100 is shown with all the additional components according to one of various embodiments of the invention. Positioned on top of support surface 103 of tank housing 101 adjacent support stand 104 is an engine enclosure 102 configured as a rectangular box. Under the engine enclosure 102 is an engine (power device) supported upon the support surface 103 of tank housing 101. An exemplary engine includes a gasoline engine and alternatively a diesel engine. An exemplary power rating for an exemplary engine ranges from about 100 horsepower to about 400 horsepower (or about 200 horsepower to about 300 horsepower, or about 225 horsepower to about 275 horsepower). An exemplary engine enclosure 102 includes a door 141 to provide access to the engine, a louver 143 to control engine temperature by allowing air to enter and exit, and an air cleaner 147 and exhaust muffler 145 which are also for the engine inside the engine enclosure 102.

Still referring to FIG. 16, the exemplary embodiment of power system 100 includes additional components such as a hydraulic tank 106 which is supported upon shelves 123 of support stand 104 (described previously with respect to FIG. 14) adjacent engine enclosure 102. Hydraulic tank 106 provides the hydraulic fluid or oil for the power system 100 and ultimately for any apparatus to be driven under hydraulic power from power system 100. An exemplary hydraulic tank 106 includes a cleanout cover 149 to provide access inside hydraulic tank 106 for cleaning out purposes. Moreover, hydraulic tank 106 includes at least one filler cap 151 to cover the opening for receiving hydraulic oil and has a cosmetic cover 105 provided on one side of hydraulic tank 106.

Still referring to FIG. 16, the exemplary power system 100 further includes at least one hydraulic pump 108 in operational connection (operationally coupled) with the engine protected under engine enclosure 102. In one exemplary embodiment of the invention, the power system 100 includes two hydraulic pumps 108 (only one shown) operationally coupled with the engine. It should be understood that the hydraulic pumps 108 will, for one embodiment of the invention, be operationally coupled to other apparatuses on the self-propelled vehicle, such as the grinder apparatus 300. For example, the engine will drive the hydraulic pumps 108 which will provide the hydraulic oil at operational pressure for components on the road grader such as the hydraulic motors 304 and 307 described previously for grinder apparatus 300. A portion of one hydraulic pump 108 is shown through legs 121 of support stand 104 and includes hydraulic filter 161 also shown through legs 121. A plurality of gauges 163 are secured to support stand 104 and are in communication with hydraulic components such as the hydraulic pumps 108 for monitoring of operational parameters such as hydraulic oil pressure.

Still referring to FIG. 16, the exemplary embodiment of power system 100 further includes hydraulic oil cooler 110 which maintains the hydraulic oil at proper temperature. The exemplary hydraulic oil cooler 110 includes a housing 111 surrounding and protecting a set of cooling coils 157. A conduit 155 provides fluid communication between the set of cooling coils 157, hydraulic tank 106 and hydraulic pumps 108. An exemplary support shelf 164 extends forward of support stand 104 and tank housing 101 and provides support to hydraulic oil cooler 110. Additionally, connection braces 113 are secured to hydraulic tank 106 in/or support stand 104 (or both) and to housing 111 provide additional stability for supporting hydraulic oil cooler 110. Tubing 317 is illustrated extending from power system 100 and will ultimately provide fluid communication to additional hydraulic components such as hydraulic motors 304 and 307 of the inventive grinder apparatus 100 described previously. It should be understood that various other lines, conduits and/or tubing may extend from power system 100 as needed. A plurality of openings 165 are shown provided throughout the structure of housing 111 to dissipate the heat from cooling coils 157.

Still another exemplary embodiment (not shown) of the invention representing inventive apparatuses for servicing (maintaining and repairing) roads/roadways includes replacing components for the exemplary power system or power units, just described, with different components. For example, for this inventive embodiment, the two hydraulic pumps 108 previously described are replaced with an electric generator. Accordingly, for this inventive embodiment, the electric generator is operationally coupled to the engine which was previously described. Further for this exemplary embodiment of the invention not shown, the previously-described hydraulic components are replaced by electrical components, such as electric drive motors, which would be operationally coupled to the electric generator. The electric drive motors would be operationally coupled to drive the drum 305 previously described.

Figure 17:
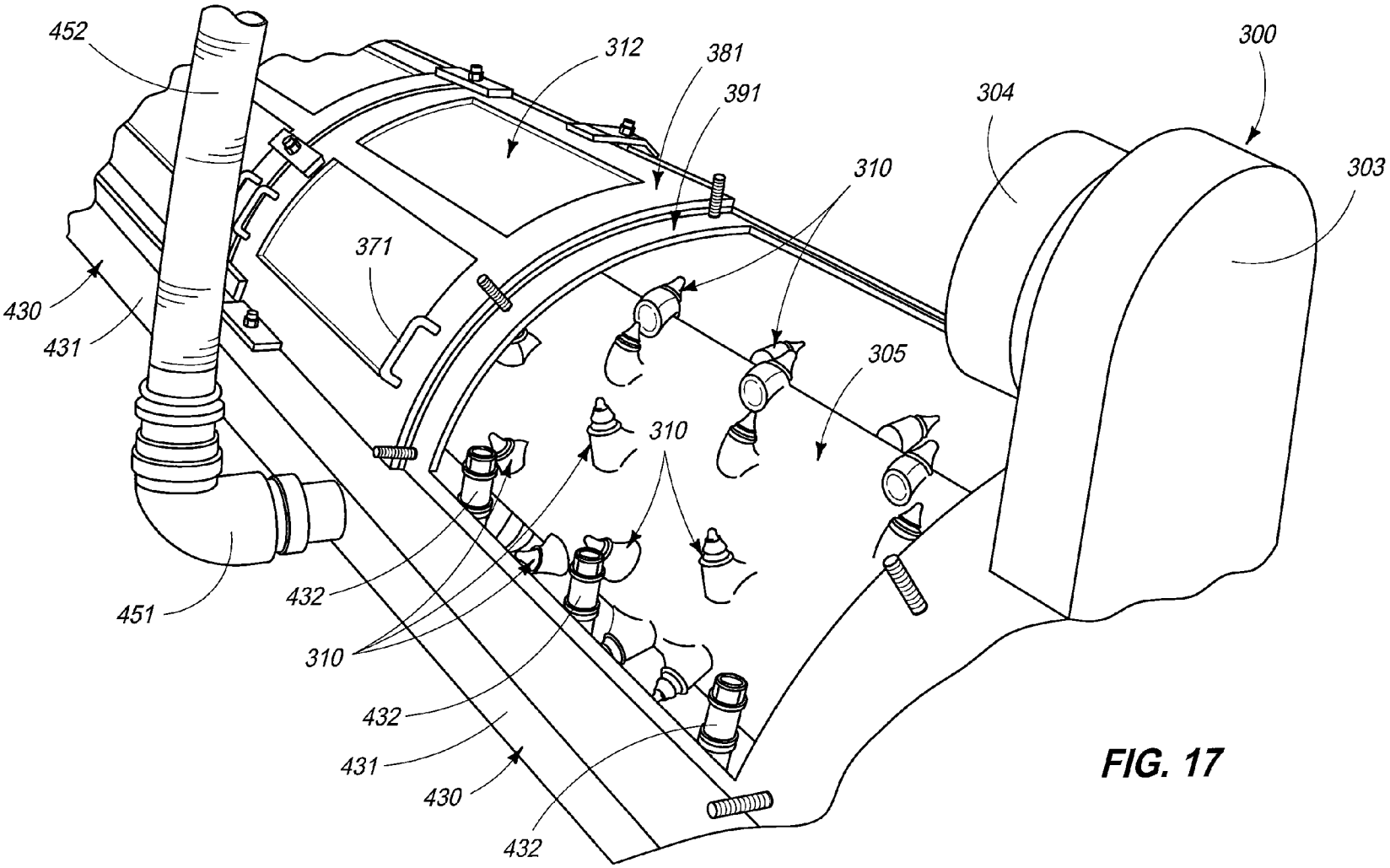
FIG. 17 is a fragmentary perspective view of the inventive grinder apparatus of FIG. 1 more thoroughly illustrating additional exemplary structure.

Referring to FIG. 17, another one of the various exemplary embodiments of the invention representing an inventive apparatus for servicing (maintaining and repairing) roads and roadways is described and illustrated. The inventive apparatus is the fluid spray system (or fluid flow system) 430 mentioned previously. Moreover, as stated previously, while subsequent portions of the description are described with regard to the inventive grinder apparatus 300, the inventive fluid spray system 430 can be a stand-alone system/structure without the grinder apparatus 300, and alternatively, can be provided to be supported upon other structures and systems needing fluid distribution and spraying.

Still referring to FIG. 17, a portion of an exemplary fluid spray system 430 includes spray heads 432 positioned inside of frame structure 391 of grinder apparatus 300 and facing the drum 305 and extending from spray bar 431. The spray heads 432 are supported upon, and in fluid communication with, the spray bar 431 to selectively provide fluid to drum 305. It should be understood that spray heads 432 could also be supported upon spray bar 431. In this exemplary embodiment, the fluid spray system 430 does not include the structure of the plurality of spray valve adjustment nuts 414 shown and described previously relative to FIG. 1. In this exemplary embodiment, it should be understood that fluid pressure is established in the spray bar 431 and spray heads 432 without the valve structures of spray valve adjustment nuts 414 with spray pins (both described and shown with respect to FIG. 19). Alternatively, an exemplary fluid spray system 430 includes a single valve structure configured to operate only a single exemplary spray head 432. Still further, an exemplary fluid spray system 430 includes a single valve structure configured to operate two or more exemplary spray heads 432.

Figure 18:
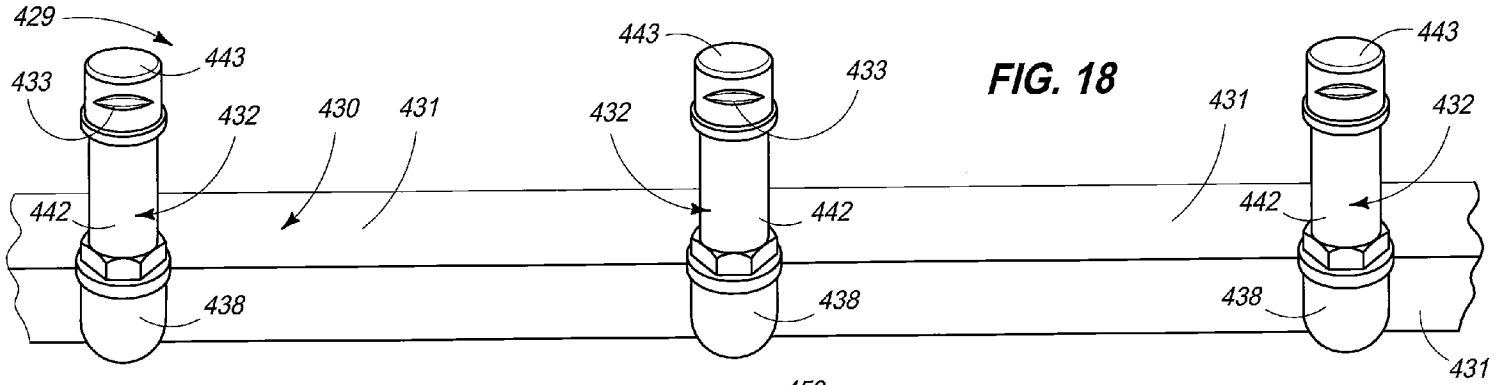
FIG. 18 is a fragmentary perspective view of a portion of an exemplary fluid flow system according to one of various embodiments of the invention.

Referring to FIG. 18, another perspective 429 of the portion of the exemplary fluid spray system 430 of FIG. 17 is illustrated. Each exemplary spray head 432, according to one embodiment of the invention, includes an elbow conduit 438 extending from and in fluid communication with spray bar 431, a tube 442 extending upwardly, and a cap 443 terminating the spray head 432. An exemplary cap includes a spray opening (slot) 433 which faces drum 305 wherein fluid is provided (sprayed) toward drum 305.

Figure 19:
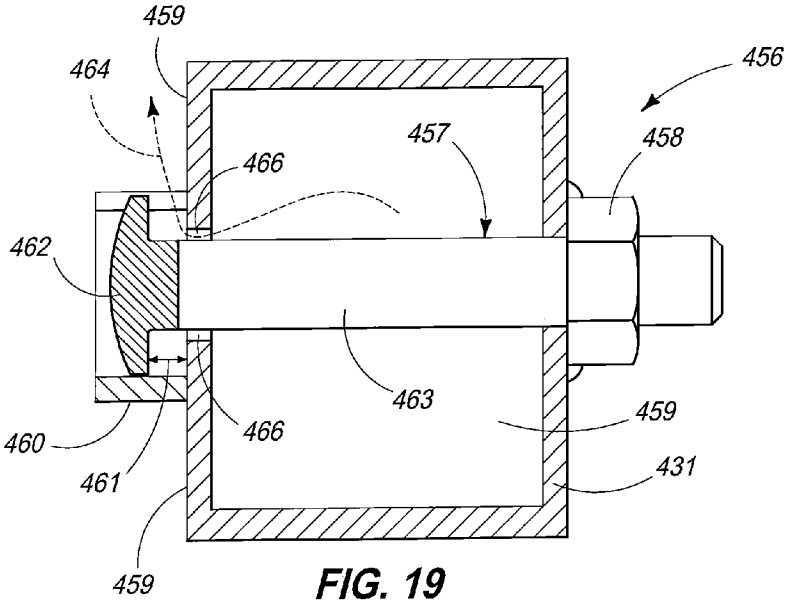
FIG. 19 is a side sectional view of a portion of another exemplary fluid flow system according to one of various embodiments of the invention.
Figure 19A:
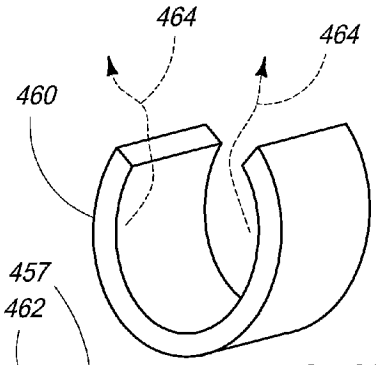
FIG. 19A is a perspective view of structure of the fluid flow system of FIG. 19 according to one of various embodiments of the invention.

Referring to FIGS. 19 and 19A, another inventive spray device 456 is illustrated according to another embodiment of the invention which could replace spray heads 432, and alternatively, be used in combination with spray heads 432. The exemplary spray device 456 includes the spray bar 431 previously described, a nut 458 secured to the rear side of the spray bar 431 (not facing drum 305), and a spray pin 457. An exemplary spray pin 457 includes a stem 463 and a head portion 462 at a terminal end of stem 463. Opposite the head portion 462, the stem 463 threadingly engages nut 458 similar to nuts 414 previously described with respect to FIG. 1 and functions as a spray valve adjustment nut. The threading cooperation between stem 463 and nut 458 provides the capability of adjusting the spacing or distance 461 between the head portion 462 and a spray opening 466 located in a front face 459 (facing drum 305) of the spray bar 431. The head portion 462 of spray pin 457 slidingly engages or rides upon a flow direction device 460 (see FIG. 19A).

Still referring to FIGS. 19 and 19A, it should be understood that this configuration spray device 456 allows for spray pin 457 to be selectively adjusted between a closed and opened position. An exemplary closed position has head portion 462 against the front face 459 of spray bar 431 to block or close (cover) spray opening 466 to prevent fluid flow 464. Threading stem 463 of spray pin 457 through nut 458 to move head portion 462 away from the front face 459 of spray bar 431 will unblock spray opening 466 to allow fluid flow 464. Increasing or decreasing the distance 461 between the head portion 462 and the front face 459 of spray bar 431 will modify the intensity or volume of fluid flow 464 through spray opening 466.

Figure 19B:
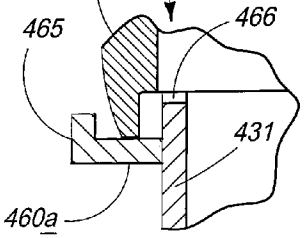
FIG. 19B is a fragmentary side sectional view of a portion of another exemplary fluid flow system according to another of the various embodiments of the invention.

Referring to FIG. 19B, a modification to the inventive spray device 456 of FIGS. 19 and 19A is illustrated according to one of various embodiments of the invention. For this embodiment, the spray pin 457 is not threadingly engaged with nut 458 and simply slides through the rear side of spray bar 431 without impediment and is biased in the closed position via a spring (not shown). Once a fluid pressure develops in the spray bar 431 to a threshold pressure which overcomes the biasing force of the spring, the fluid pressure will force the head portion 462 of spray pin 457 away from the front face 459 of spray bar 431 to allow the fluid to flow through the spray opening 466. This embodiment of spray device 456 further includes a flow direction device 460*a* having a lip 465 to prevent the head portion 462 of spray pin 457 from sliding off the flow direction device 460*a* if the fluid pressure reaches such a critical pressure.

Figure 20:
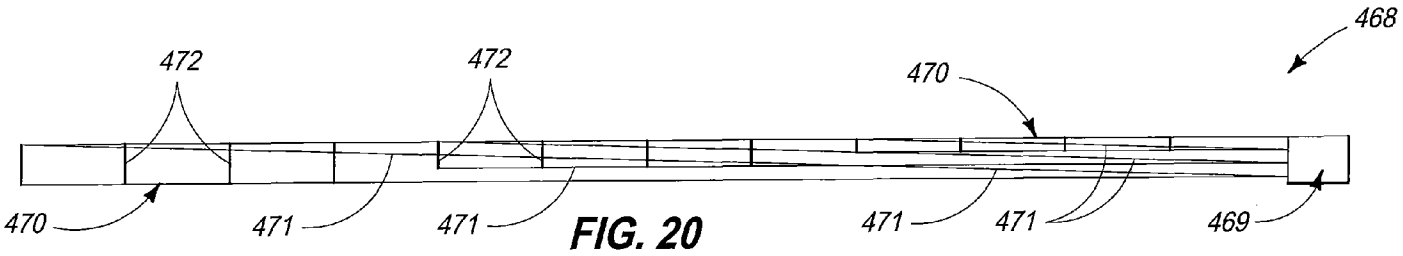
FIG. 20 is a front view of a portion of another exemplary fluid flow system according to another of the various embodiments of the invention.
Figure 21:
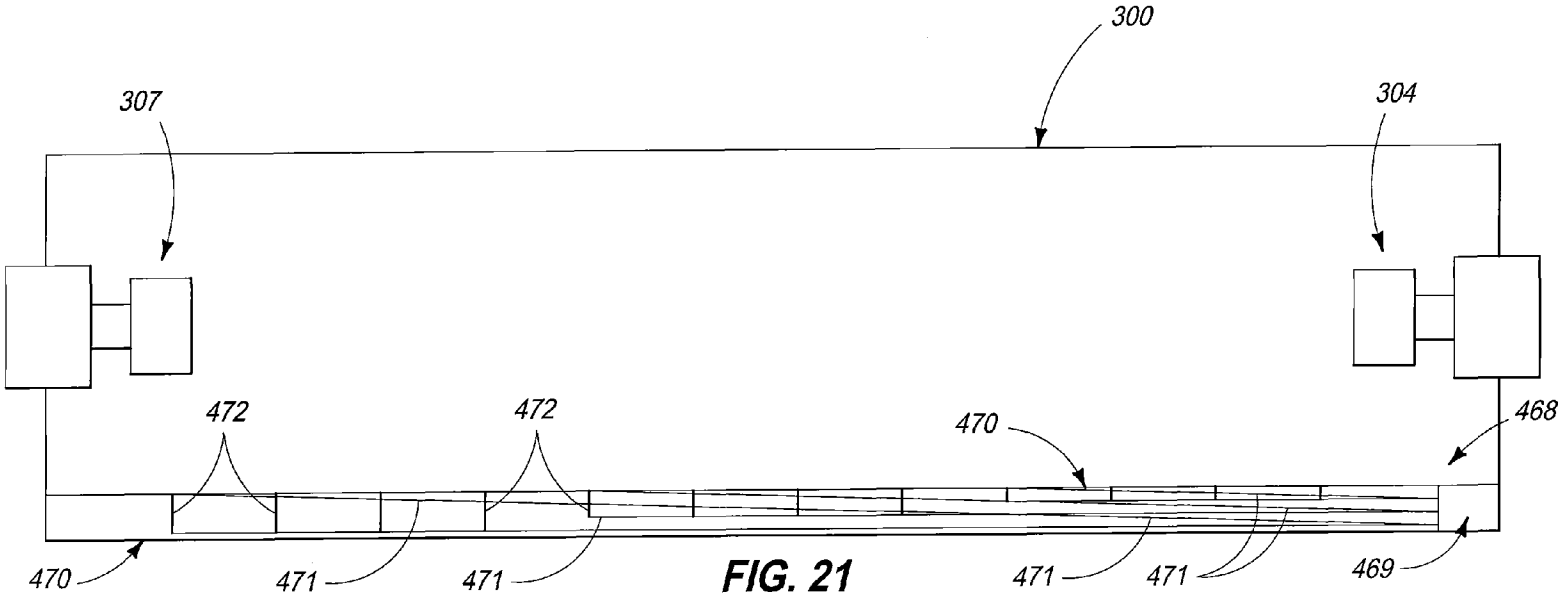
FIG. 21 is a top view of the fluid flow system of FIG. 20 illustrated with the inventive grinder apparatus of FIG. 1, illustrated in a simplified view, according to one of the various embodiments of the invention.

Referring to FIGS. 20 and 21, another inventive fluid spray bar 468 is illustrated according to one of various embodiments of the invention. An exemplary fluid spray bar 468 includes a manifold 469 at one end of an elongated conduit housing 470. An exemplary conduit housing 470 houses conduits 471 which provide fluid communication between manifold 469 and nozzles 472. It should be understood that one conduit 471 could be dedicated to one nozzle 472, and alternatively, one conduit 471 could be dedicated to two more nozzles 472. For example, one conduit 471 can be dedicated to two nozzles 472, three nozzles 472, or four nozzles 472, etc. Still further, two or more conduits 471 can be dedicated to one nozzle 472. As illustrated in FIG. 21, the inventive fluid spray bar 468 can be secured to the inventive grinder apparatus 300 as described previously for the various other inventive embodiments of spray bars.

Figure 22:
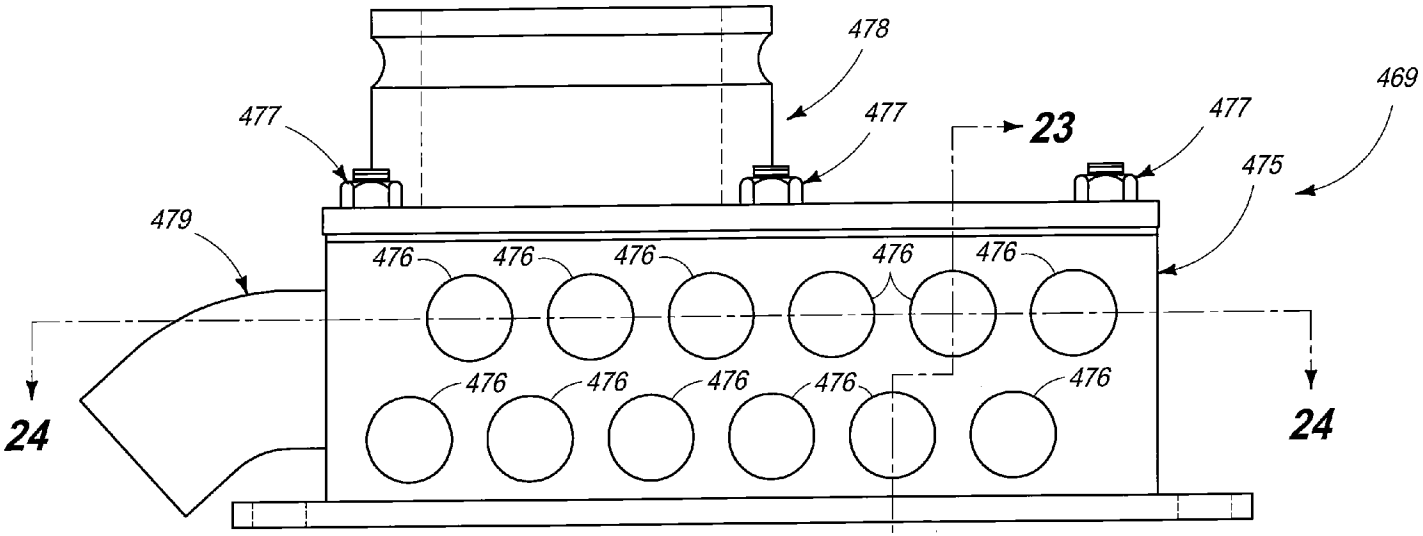
FIG. 22 is a side view of a portion of another exemplary fluid flow system according to another of the various embodiments of the invention.
Figure 23:
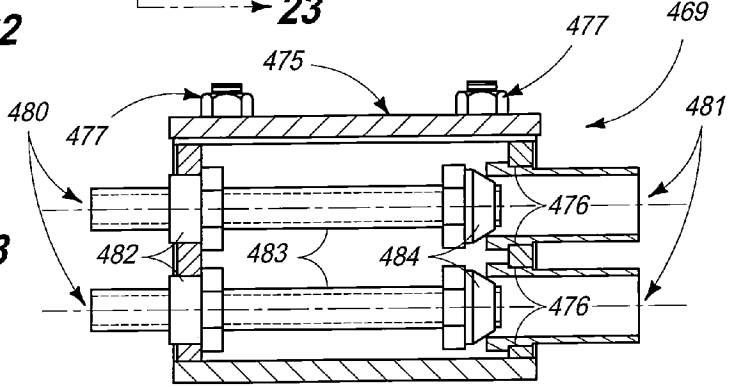
FIG. 23 is a sectional view of the FIG. 22 view taken along sectional lines 23-23.
Figures 24, 25:
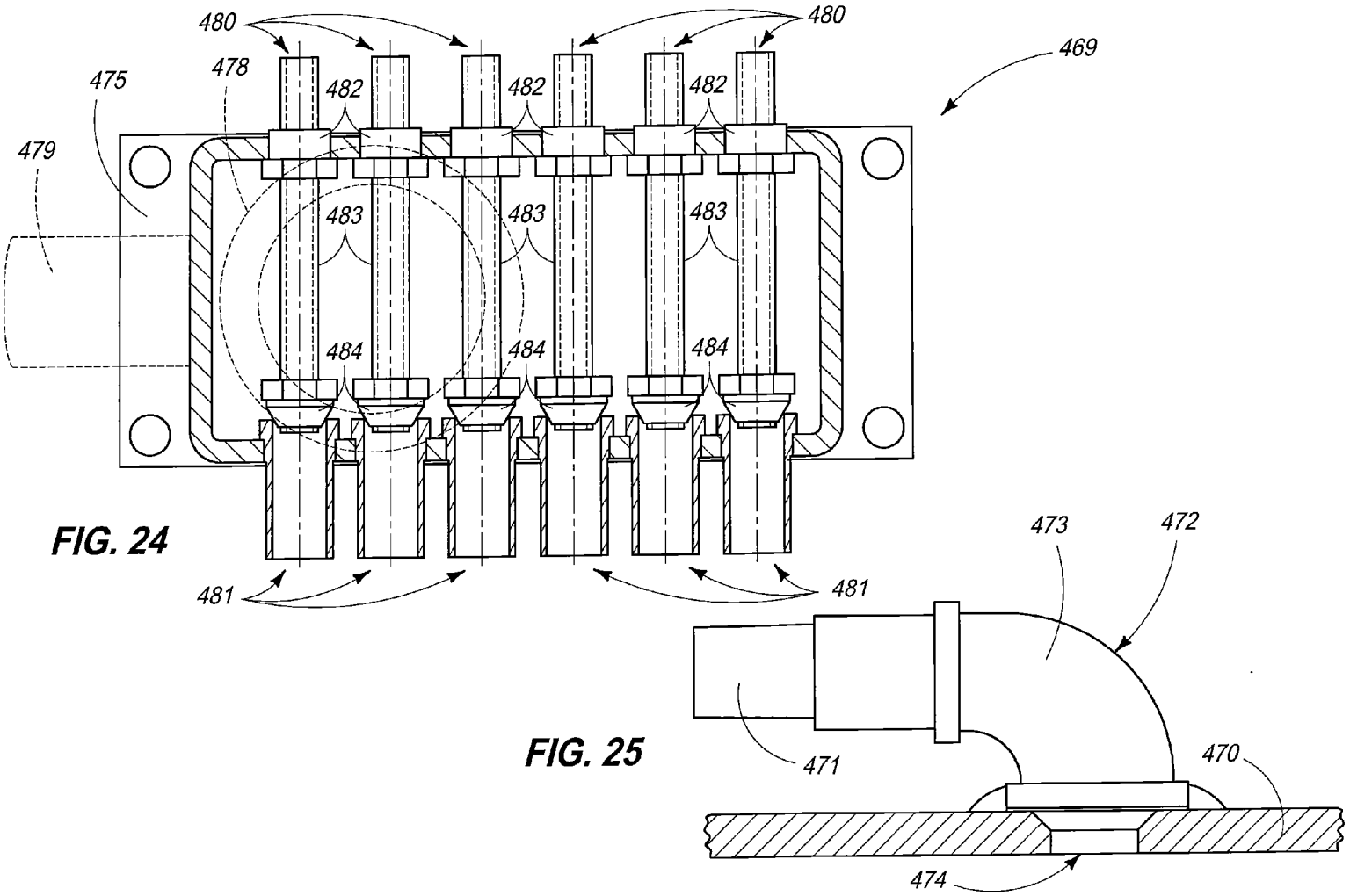
FIG. 24 is a sectional view of the FIG. 22 view taken along sectional lines 24-24.
FIG. 25 is a top, partial sectional view of a portion of another exemplary fluid flow system according to another of the various embodiments of the invention.

Referring to FIGS. 22, 23 and 24, the exemplary manifold 269 is more thoroughly disclosed and includes a manifold housing 475 held together by bolt/nut combinations 477. The exemplary manifold housing 475 includes an intake flange 478 in fluid communication with the interior of the manifold housing 475 and configured to receive the end of a tube or conduit (not shown) such as fluid hose 452 described previously. It should be understood that this tube or conduit provided over intake flange 478 will be connected to a fluid source (discussed subsequently) that is to be provided to the manifold housing 475 and ultimately sprayed over drum 305 of the inventive grinder apparatus 300. Moreover, the exemplary manifold housing 475 includes a cleanout spout 479 that is in fluid communication with the interior of the manifold housing 475 to allow cleaning of said interior. Still further, the exemplary manifold housing 475 includes a side wall having at least one opening 476, and in this example, twelve openings 476. Openings 476 have nipples 481 secured therein. The exemplary nipples 481 receive one end of conduits 471 that are housed in the manifold housing 475 wherein opposite ends of conduits 471 are received on spray nozzles 472 to establish fluid communication between the manifold 469 and the spray nozzles 472. It should be understood that alternatively conduits 471 could be applied directly through or over openings 476 to establish the fluid communication between the manifold 469 and the spray nozzles 472.

Still referring to FIGS. 23 and 24, the exemplary manifold 469 includes valves 480 having stems 483 which terminate to form conical heads 484. The end of each stem 483 extends through respective nut/seal combinations 482 in threaded engagement. The threaded engagement provides the capability for each valve 480 to be selectively moved axially toward, and alternatively away from, nipples 481. In this fashion, valves 480 can selectively open and close fluid communication to the nipples 481 from manifold 469 thereby selectively preventing, and alternatively allowing, fluid to reach the spray nozzles 472. It should be understood that the threaded engagement of valves 480 is a manual operation for selectively activating the spray action of spray nozzles 472. However, for other various embodiments of the invention, valves 480 can be pneumatically activated, hydraulically activated, or electrically activated. It should be understood that for a manifold 469 having a plurality of valves 480, any combination of valves 480 can be selected for activation while any other combination of valves 480 can be selected for inactivation. Still further, it should be understood that manifold 469 and valves 480 can be used in combination with the previously described fluid spray system 430 and spray device 456.

Referring to FIG. 25, the exemplary spray nozzle 472 is illustrated according to one of various embodiments of the invention and includes a nozzle opening 474 extending through conduit housing 470. The spray nozzle 472 includes an elbow tube 473 connected to conduits 471 in fluid communication. It should be understood that spray nozzles 472 can be used in fluid spray system 430 to replace, or provided in combination with, the previously-described spray heads 432. Furthermore, it should be understood that spray nozzle 472 can be used to replace, or provided in combination with, the previously-described spray device 456.

It should be understood that any one of the various embodiments of the fluid spray systems, apparatuses or devices for spraying a fluid over the inventive drum 305 of the inventive grinder apparatus 300 disclosed throughout this document can spray any fluid according to various embodiments of the different inventions. An exemplary fluid includes a liquid such as water only. Alternatively, exemplary fluids include water and one or more other fluids, solids or liquid additives. Exemplary other fluids, solids or liquid additives include cement, Portland cement (OPC), lime, chlorides, salts, chloride salts, clays, electrolytes, electrolyte emulsions, enzymes, enzymatic emulsions, lignosulfonates, polymers, synthetic polymers, synthetic-polymer emulsions, tree-resin emulsions and other additives. Each fluids, solids or liquid additives can be provided in any combination and each fluids, solids or liquid additives can be provided in any percentage of the total combination percentage.

Figure 26:
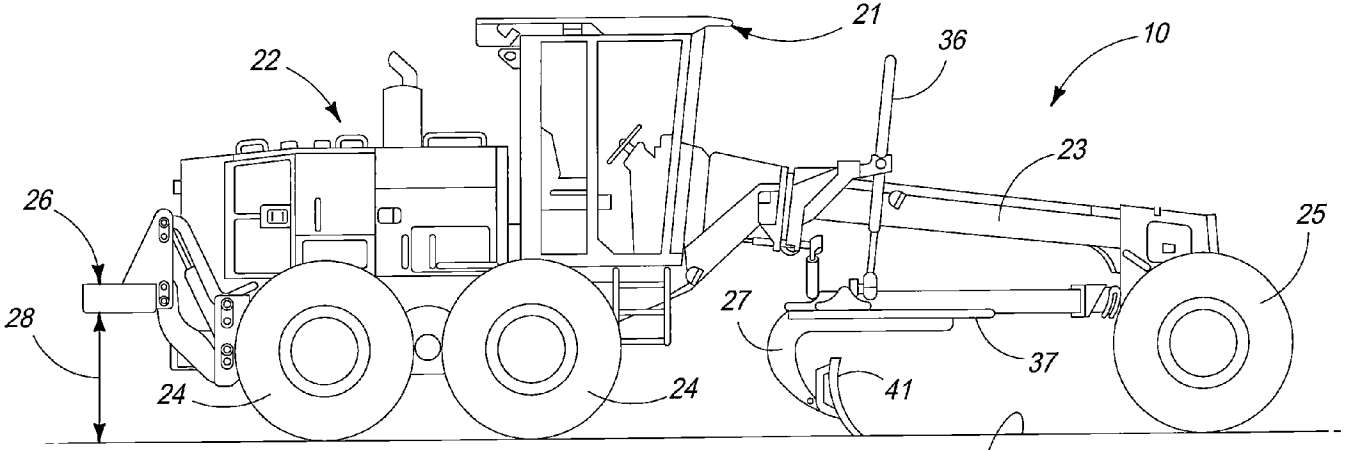
PRIOR ART FIG. 26
FIG. 26 is a side view of a conventional road grader.
Figure 27:
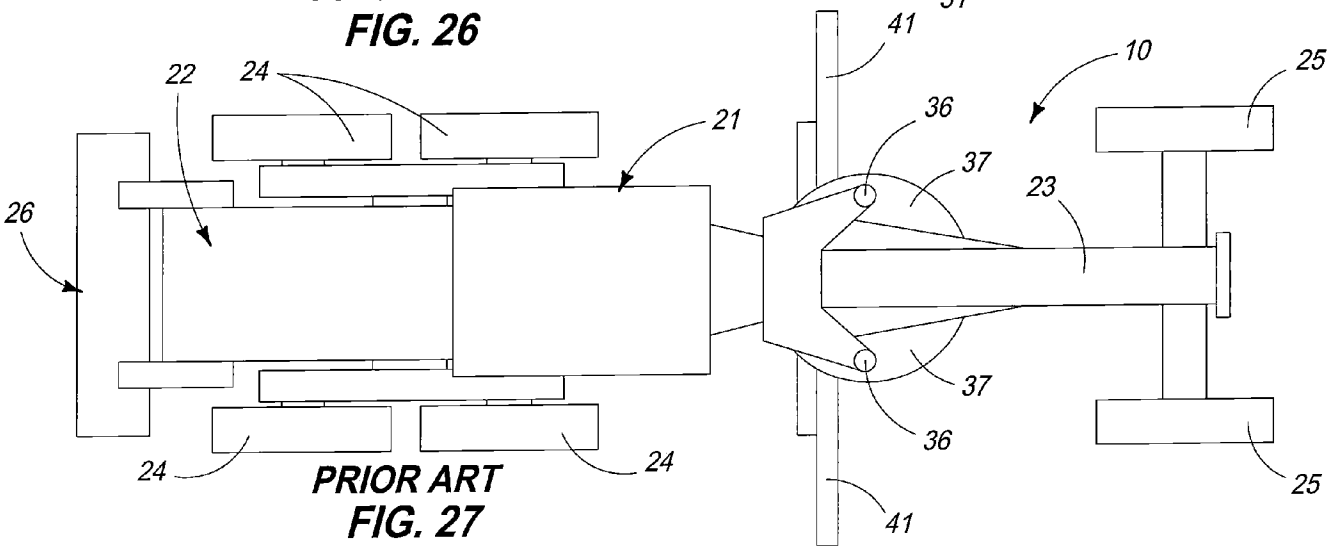
PRIOR ART FIG. 27
FIG. 27 is a top view of the conventional road grader of FIG. 26.

Referring to FIGS. 26 and 27, an exemplary conventional (prior art) self-propelled vehicle is illustrated which can be used with the inventive apparatuses and systems (structures) described herein for servicing (maintenance and repair) substrate surfaces such as roadways. An exemplary self-propelled vehicle is a road grader (motor grader) 10 and which is manufactured or sold by John Deere, Volvo, Case and Caterpillar. The conventional road grader includes a main frame 23 supported upon a pair of front steering wheels 25 and two pairs of rear wheels 24. A combustion engine 22, such as a diesel, is supported upon main frame 23 over rear wheels 24. A ripper 26 extends rearward of the combustion engine 22 and is a support device in combination with a lifting device capable of moving vertically up and down along direction 28. A cab 21 is supported upon main frame 23 forward of the combustion engine 22. Hydraulically-operated cylinders (hoist cylinders) 36 are supported upon main frame 23 and pivotedly (pivotably) secured to an adjustable turntable 37. A blade bracket 27 secures a blade (road blade or moldboard) 41 to the turntable 37.

Figure 28:
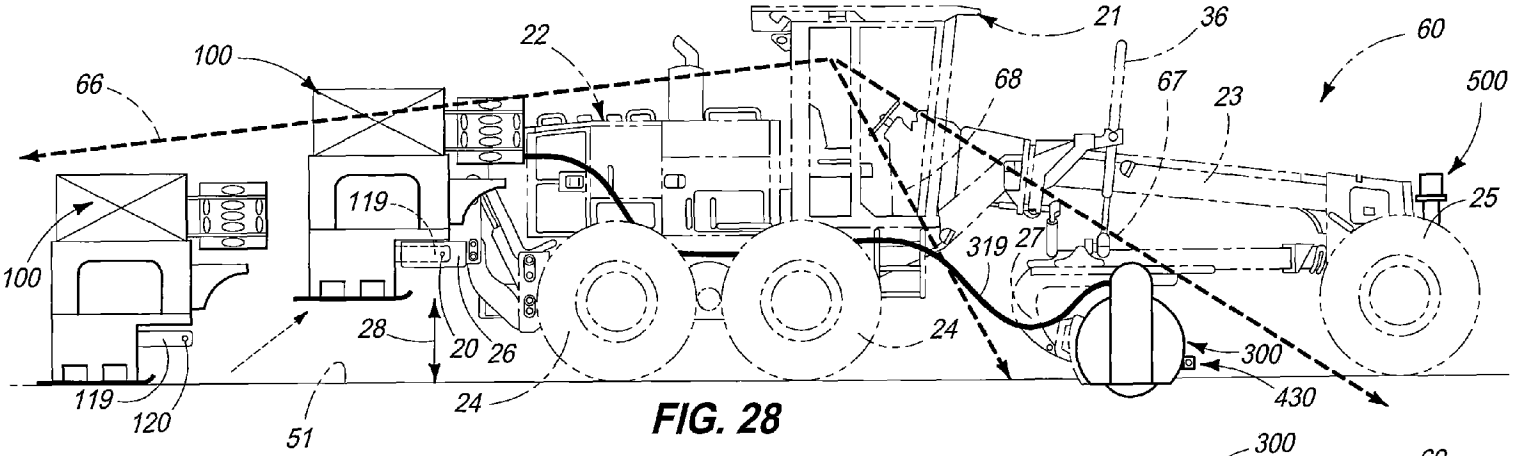
FIG. 28 is a side view of the conventional road grader of FIG. 26 illustrated with the inventive grinder apparatus of FIG. 1 and with the inventive power system of FIG. 16 according to one of various embodiments of the invention.
Figure 29:
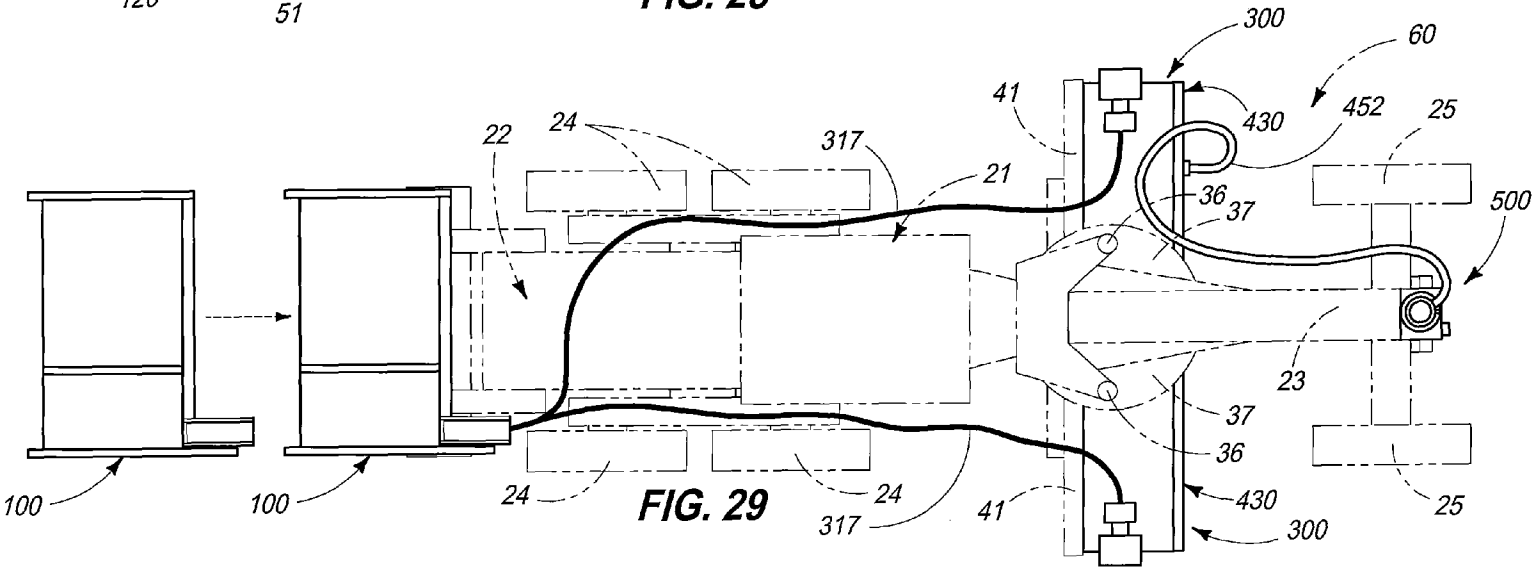
FIG. 29 is a top view of the FIG. 28 view.

Referring to FIGS. 28 and 29, the various exemplary embodiments of the inventions for maintaining and repairing roads and roadways described and illustrated throughout this application are shown in inventive embodiments of application with the conventional road grader discussed previously. According to one exemplary embodiment of the invention, a road grader 60 (motor grader) is illustrated with inventive grinder apparatus 300, fluid pump system 500, fluid spray system 430 (it should be understood this includes the spray nozzles 472 and spray device 456) and hydraulic power system 100 secured to road grader 60. It should be understood that various other embodiments of the invention include any combination of these inventive apparatuses and systems being secured to road grader 60. For example only, an exemplary inventive road grader combination could have only the inventive hydraulic power system 100 secured to road grader 60; could have only the inventive grinder apparatus 300 secured to road grader 60; could have only the inventive fluid pump system 500 secured to road grader 60; and could have only the inventive fluid spray system 430 secured to road grader 60. Alternatively, only the combination of the inventive hydraulic power system 100 and the inventive grinder apparatus 300 are secured to road grader 60, and any other of the other various combinations.

Still referring to FIGS. 28 and 29 (particularly FIG. 28), the inventive hydraulic power system 100 is shown supported upon a substrate 51 which supports the road grader 60, and additionally, then moved to be supported upon rear structure of the road grader 60. For one exemplary embodiment of the invention, the inventive hydraulic power system 100 is secured and attached to the ripper 26 of the road grader 60 via a support arm 119 which is discussed more thoroughly subsequently. From these figures, an inventive aspect of the road grader 60 can easily be shown that does not exist in the conventional road graders. That is, the inventive attachment and securement of the hydraulic power system 100 to the road grader 60 allows for a substantial line-of-sight 66 rearward from an individual in the cab 21 particularly since the hydraulic power system 100 can be lowered via the ripper 26 to be removed from view.

Similarly and still referring to FIGS. 28 and 29, another inventive aspect of the road grader 60 that does not exist in the conventional road graders is the inventive attachment and securement of the grinder apparatus 300 to the road grader 60. This inventive attachment and securement allows for a substantial first line-of-sight 67 between the grinder apparatus 300 and front steering wheels 25 to the substrate 51. Moreover, the inventive attachment and securement allows for a substantial second line-of-sight 68 between the grinder apparatus 300 and the cab 21 to the substrate 51. These lines-of-sight allow for the individual in the cab 21 to inspect the substrate 51 immediately in front and behind the grinder apparatus 300 during churning/grinding operation to allow for quick modification of operational parameters to any one of the inventive systems and apparatuses. That is, operational modifications can be made "on the fly" without the individual having to stop operation to exit the cab 21 which completely avoids operational downtime. Conventional (prior art) methods for operating road grader 60 routinely included stopping operation to allow the operator to exit the cab 21 and inspect the ground-up substrate 51.

Still referring to FIGS. 28 and 29, a simplistic view of an inventive configuration for the fluid pump system 500 with road grader 60 is shown and more thoroughly discussed with reference to FIGS. 30-31. Additionally, the inventive fluid pump system 500 is shown with the fluid hose 452 coupled between the fluid pump system 500 and inventive fluid spray system 430.

Figure 30:
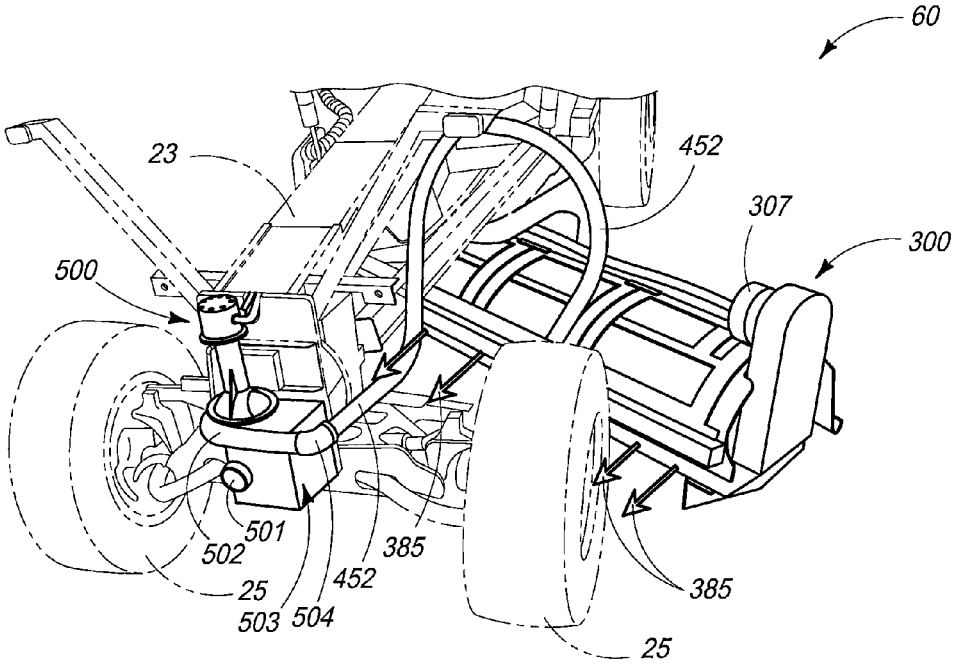
FIG. 30 is a fragmentary perspective view of the conventional road grader of FIG. 26 with the inventive grinder apparatus of FIG. 1 and with a portion of an exemplary fluid flow system according to another of the various embodiments of the invention.
Figure 31:
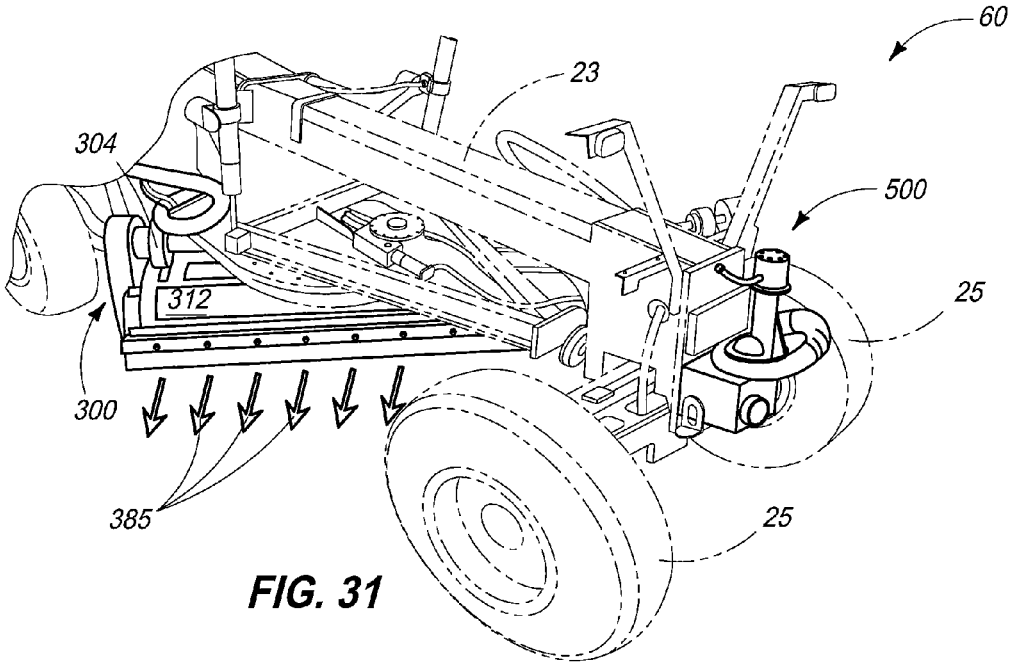
FIG. 31 is a different perspective view of the FIG. 30 view.

Referring to FIGS. 30-31, the fluid pump system 500 is illustrated according to one of various embodiments of the invention and is secured to road grader 60 at the front-most section of main frame 23. An exemplary fluid pump system 500 includes a fluid pump 503, a fluid intake opening 501 in fluid communication with fluid pump 503 and a fluid outtake conduit 502 in fluid communication with the fluid pump 503. The fluid pump system 500 further includes an elbow pipe 504 connecting fluid outtake conduit 502 in fluid communication with fluid hose 452 which attaches to a fluid spray system such as fluid spray system 430. It should be understood that a fluid source is connected to fluid intake opening 501 to provide fluid to the fluid pump system 500 and ultimately the fluid spray system. An exemplary method for providing a fluid source is having a truck with a fluid tank drive in front of road grader 60 as it is operating with a fluid conduit connected between the fluid tank and the fluid intake opening 501 of fluid pump system 500.

Still referring to FIGS. 30-31, as inventive grinder apparatus 300 operates, the material from the substrate being repaired and/or maintained can be driven or thrown along action/direction arrows 385.

Figure 32:
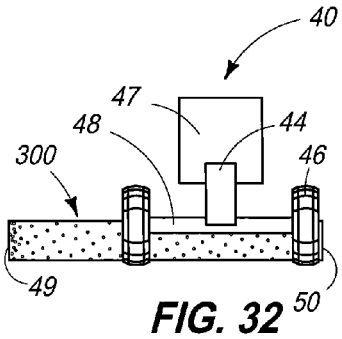
FIG. 32 is a simplified view of the conventional road grader and the inventive grinder apparatus illustrating a potential orientation of the grinder apparatus according to one of the various embodiments of the invention.
Figure 33:
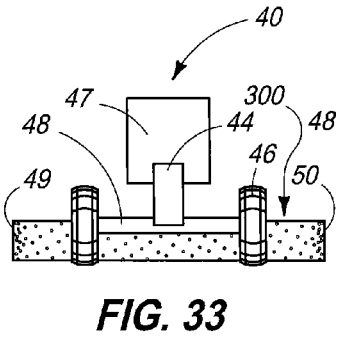
FIG. 33 is another simplified view of the conventional road grader and the inventive grinder apparatus illustrating another potential orientation of the grinder apparatus according to another of the various embodiments of the invention.

Referring to FIGS. 32-38, simplistic figures of road grader 40 are provided to illustrate a few exemplary movements/articulation/rotation of inventive grinder apparatus 300 is shown. The simplistic views have the road grader 40 with cab 47, main frame 44, adjustable turntable 51, front axle 48 extending between steering wheels 46, rear wheels 45 and inventive grinder apparatus 300 with its left side 49 (from this view) and right side 50 (from this view) referenced. One exemplary positioning of grinder apparatus 300 is shown in FIG. 32 with left end 49 extended laterally from road grader 40. It should be understood that left end 49 could be extend farther until right end 50 contacts a stop (not shown) on the road grader 40 and be positioned in any intermediate position there between. Another exemplary positioning of grinder apparatus 300 is shown in FIG. 33 with left and right ends 49, 50 positioned to extend from road grader 40.

Figure 34:
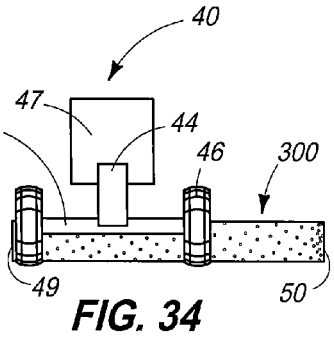
FIG. 34 is another simplified view of the conventional road grader and the inventive grinder apparatus illustrating another potential orientation of the grinder apparatus according to another of the various embodiments of the invention.
Figure 35:
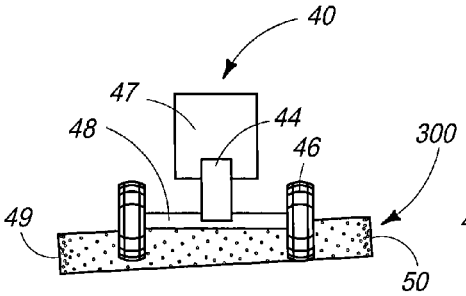
FIG. 35 is another simplified view of the conventional road grader and the inventive grinder apparatus illustrating another potential orientation of the grinder apparatus according to another of the various embodiments of the invention.
Figure 36:
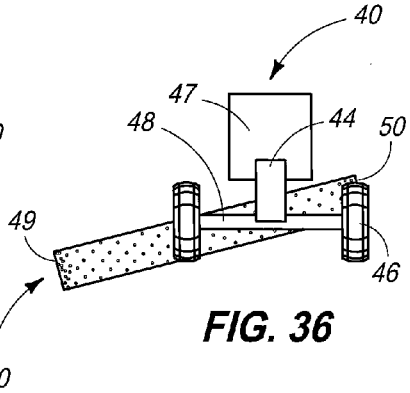
FIG. 36 is another simplified view of the conventional road grader and the inventive grinder apparatus illustrating another potential orientation of the grinder apparatus according to another of the various embodiments of the invention.

Still referring to FIGS. 32-38, another exemplary positioning of grinder apparatus 300 is shown in FIG. 34 with right end 50 extended laterally from road grader 40. It should be understood that right end 50 could be extend farther until left end 49 contacts a stop (not shown) on the road grader 40 and be positioned in any intermediate position there between. Still another exemplary positioning of grinder apparatus 300 is shown in FIG. 35 wherein grinder apparatus 300 is angled with the left end 49 lowered below steering wheels 46 upon a substrate (not shown). Yet another exemplary positioning of grinder apparatus 300 is shown in FIG. 36 wherein grinder apparatus 300 is angled greater than that shown in FIG. 35 and with the left end 49 extended laterally a greater distance than that shown in FIG. 35 and be positioned in any intermediate position there between. With regard to FIG. 36, it should be understood that the angle of grinder apparatus 300 can be increased until the right end 50 contacts a stop (not shown). It further should be understood that right end 49 could be angled and extended as shown in respective FIGS. 35 and 36 and be positioned in any intermediate position there between.

Figure 37:
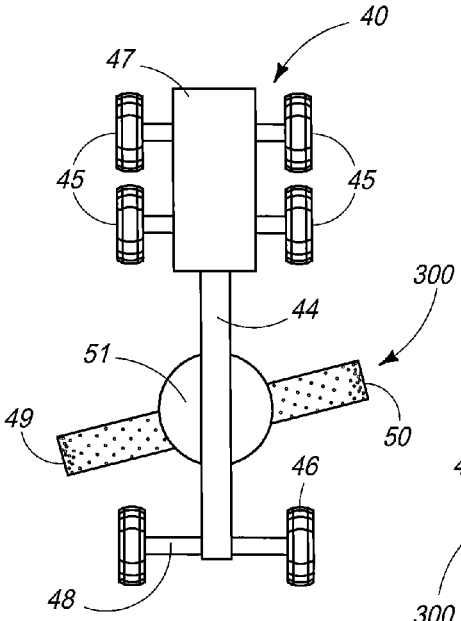
FIG. 37 is another simplified view of the conventional road grader and the inventive grinder apparatus illustrating another potential orientation of the grinder apparatus according to another of the various embodiments of the invention.
Figure 38:
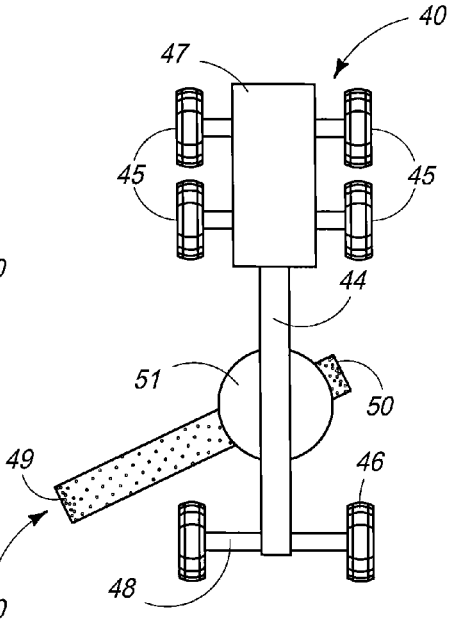
FIG. 38 is another simplified view of the conventional road grader and the inventive grinder apparatus illustrating another potential orientation of the grinder apparatus according to another of the various embodiments of the invention.

Still referring to FIGS. 32-38, another exemplary positioning of grinder apparatus 300 is shown in FIG. 37 with left and right ends 49, 50 rotated counterclockwise (from a horizontal position) via adjustable turntable 51. It should be understood that grinder apparatus 300 can be rotated counterclockwise (from a horizontal position) until one, or both of ends 49, 50 contact a stop (not shown) or other structure of the road grader 40 and be positioned in any intermediate position there between. It should further be understood that grinder apparatus 300 can be rotated clockwise (from a horizontal position) until one, or both of ends 49, 50 contact a stop (not shown) or other structure of the road grader 40 and be positioned in any intermediate position there between. Still another exemplary positioning of grinder apparatus 300 is shown in FIG. 38 with left end 49 rotated counterclockwise (from a horizontal position) via adjustable turntable 51 and extended farther than that represented in FIG. 37. Moreover, it should be understood that grinder apparatus 300 can be positioned with the right end 50 angled from the horizontal position same as the left end 49 of FIG. 37 and be positioned in any intermediate position there between.

Still referring to FIGS. 32-38, it should be understood that grinder apparatus 300 can be positioned in any combination of the positions shown and described.

Referring to FIGS. 39-46, one advantage of the inventive grinder apparatus 300 over the conventional (prior art) grinders is the simplicity and short span of time required for removing grinder apparatus 300 from the road grader 400. The inventive grinder apparatus 300 is secured to the blade or moldboard 41 of an exemplary road grader 400 and can be removed by a single person/individual in as small a length of time as two to three hours. Consequently, the method for removing grinder apparatus 300 from the road grader 400 is illustrated and described with respect to FIGS. 39-46. First referring back to FIG. 8, and for one method step according to the invention, brackets 369 are removed from side plate 353 of grinder apparatus 300 and skid plate 331 is removed from frame structure 391 (and side plate 353).

Figure 39:
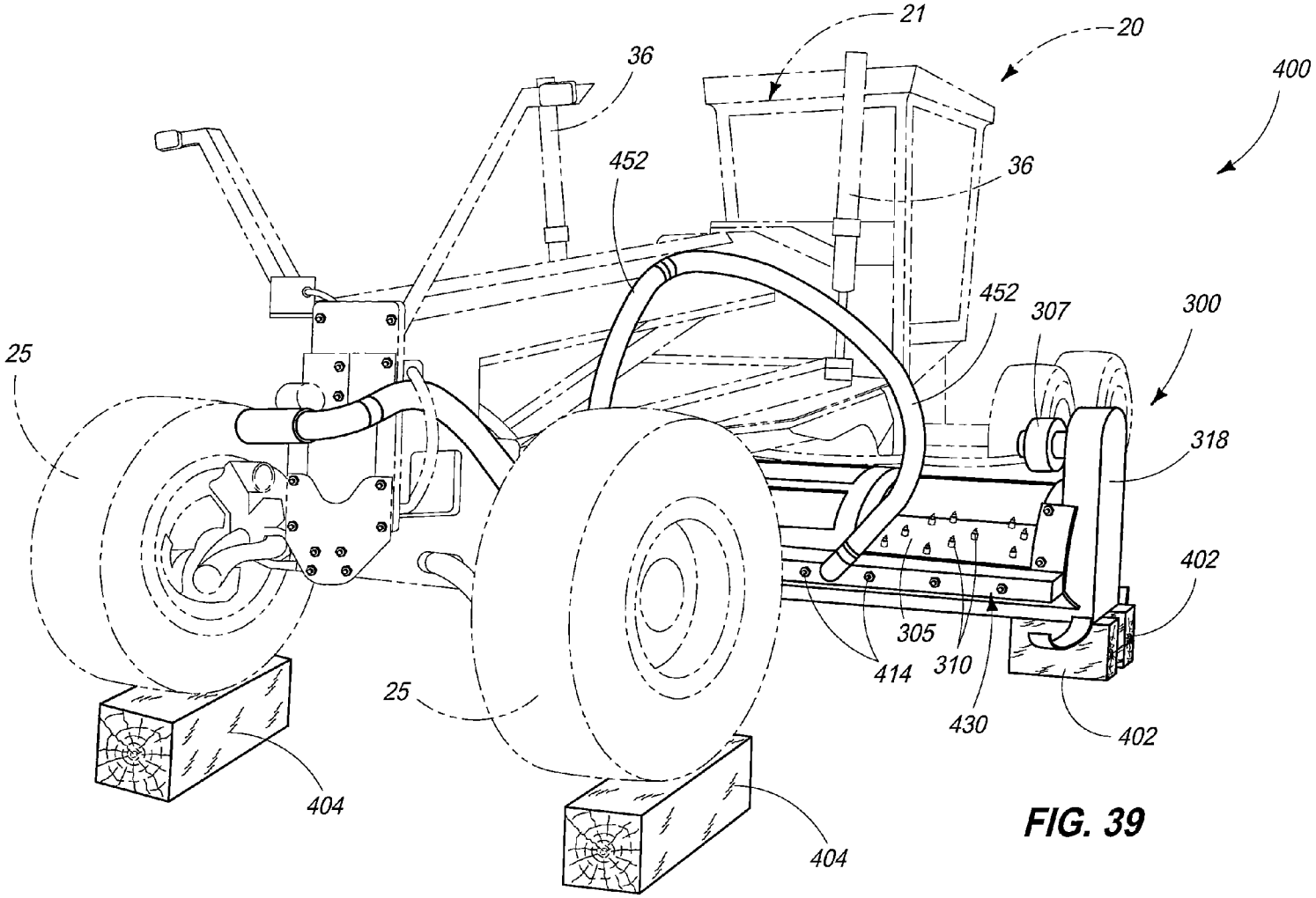
FIG. 39 is a perspective view of the conventional road grader and the inventive grinder apparatus illustrating an exemplary method step of removing the grinder apparatus from the road grader according to one of various embodiments of the invention.

Referring to FIG. 39, another method step according to the invention includes the one end of grinder apparatus 300 with the skid plate 331 removed to be elevated and placed to rest on blocks 402. Ultimately, wheels, such as a pair of caster wheels, will be positioned under this end of grinder apparatus 300, and in one embodiment of the invention, secured to the grinder apparatus 300. Another method step includes the front steering wheels 25 being elevated and placed to rest on blocks 404. Front steering wheels 25 can be lifted by utilizing hoist cylinders 36. Lifting front steering wheels 25 allows for adequate clearance for the grinder apparatus 300 to be disconnected and slide out from beneath the road grader 400.

Figure 40:
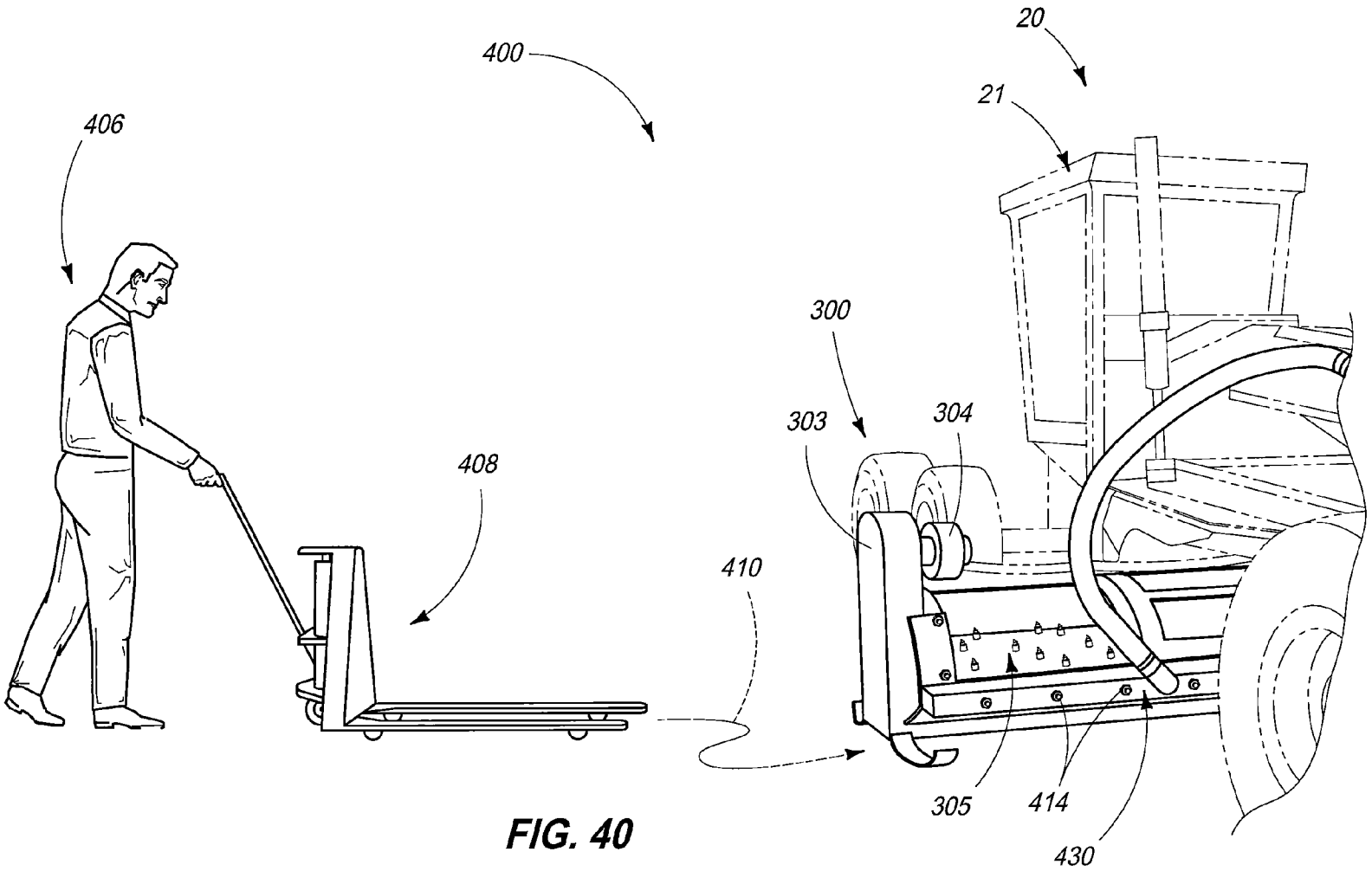
FIG. 40 is a fragmentary perspective view of the conventional road grader and the inventive grinder apparatus illustrating another exemplary method step of removing the grinder apparatus from the road grader according to one of various embodiments of the invention.

Referring to FIG. 40, another method step according to the invention includes an individual 406 rolling a lift 408 with wheels along a direction 410 to be positioned under the end of grinder apparatus 300 opposite the end resting on blocks 402. This provides the grinder apparatus 300 to rest upon a structure with wheels (lift 408) such that the grinder apparatus 300 can be rolled from beneath the road grader 400 after all other structure is detached from the grinder apparatus 300. For another embodiment of the invention, wheels such as a pair of caster wheels, will be positioned under this end of grinder apparatus 300 either with, or without, the lift 408.

Figure 41:
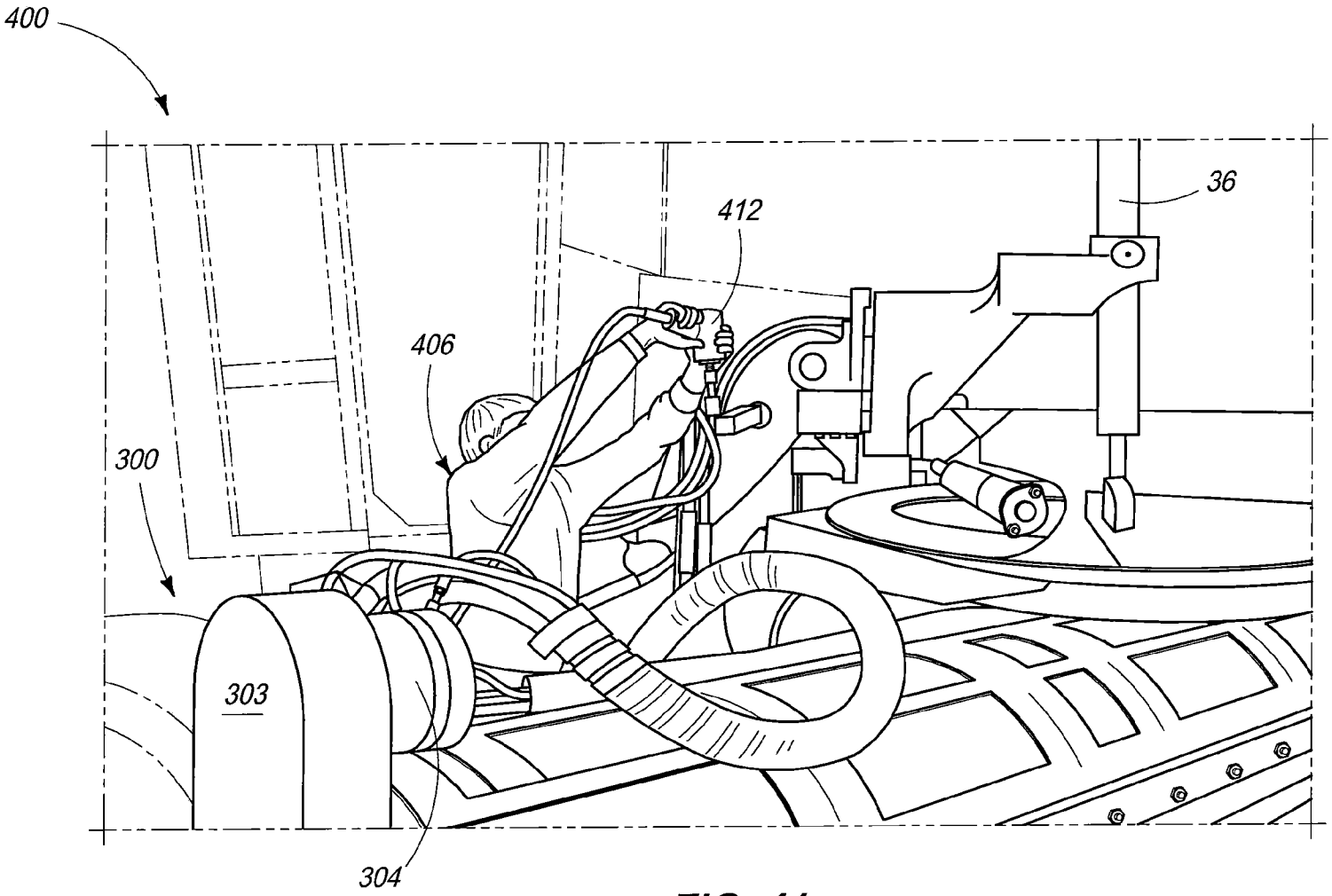
FIG. 41 is a fragmentary perspective view of the conventional road grader and the inventive grinder apparatus illustrating another exemplary method step of removing the grinder apparatus from the road grader according to one of various embodiments of the invention.

Referring to FIG. 41, another method step according to the invention includes individual 406 removing hydraulic hoses and lines from the road grader 400 with, for example, a pneumatic torque wrench 412.

Figure 42:
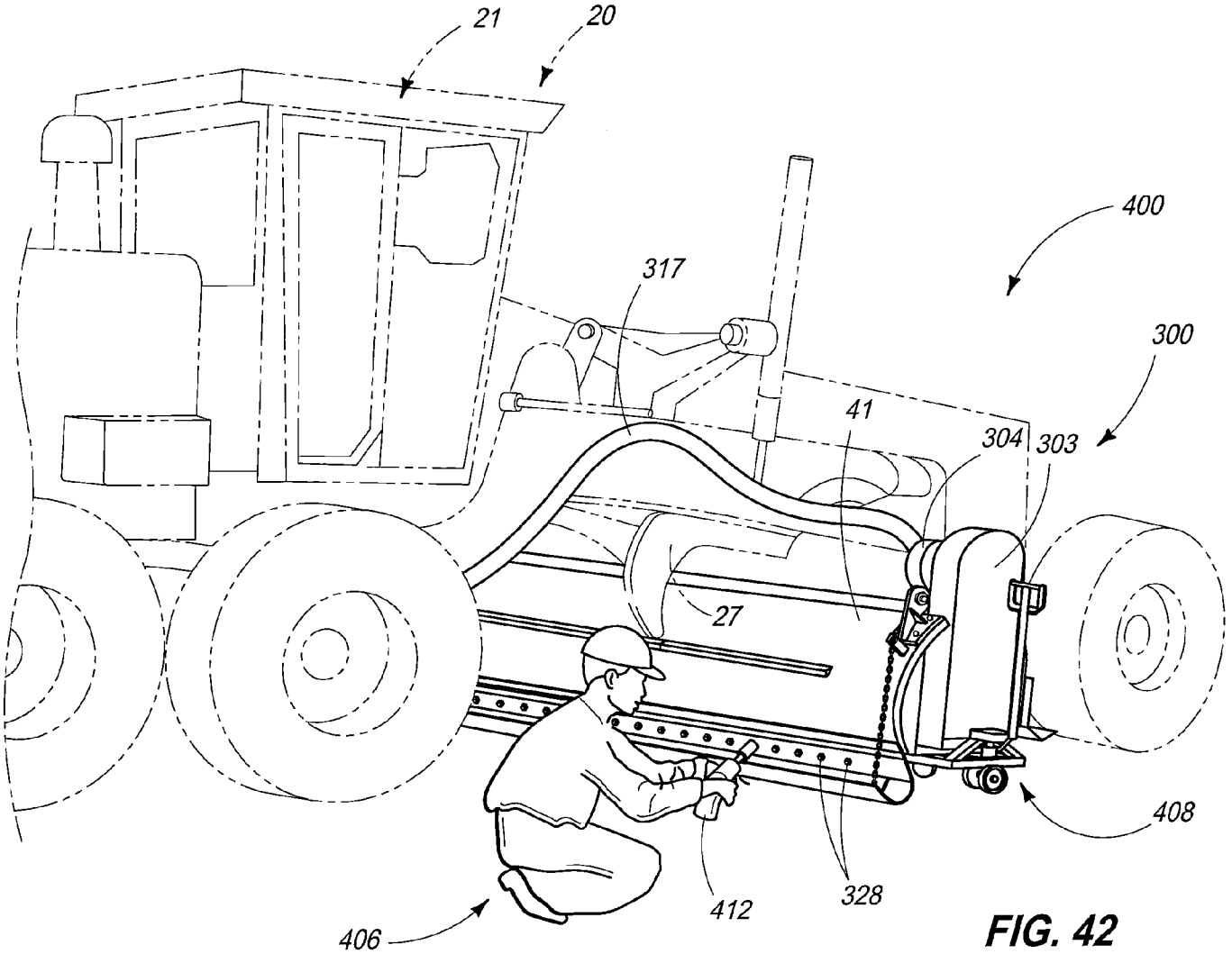
FIG. 42 is a fragmentary perspective view of the conventional road grader and the inventive grinder apparatus illustrating another exemplary method step of removing the grinder apparatus from the road grader according to one of various embodiments of the invention.

Referring to FIG. 42, another method step according to the invention includes individual 406 removing bolts 328 from the blade 41 (moldboard) of the road grader 400.

Figure 43:
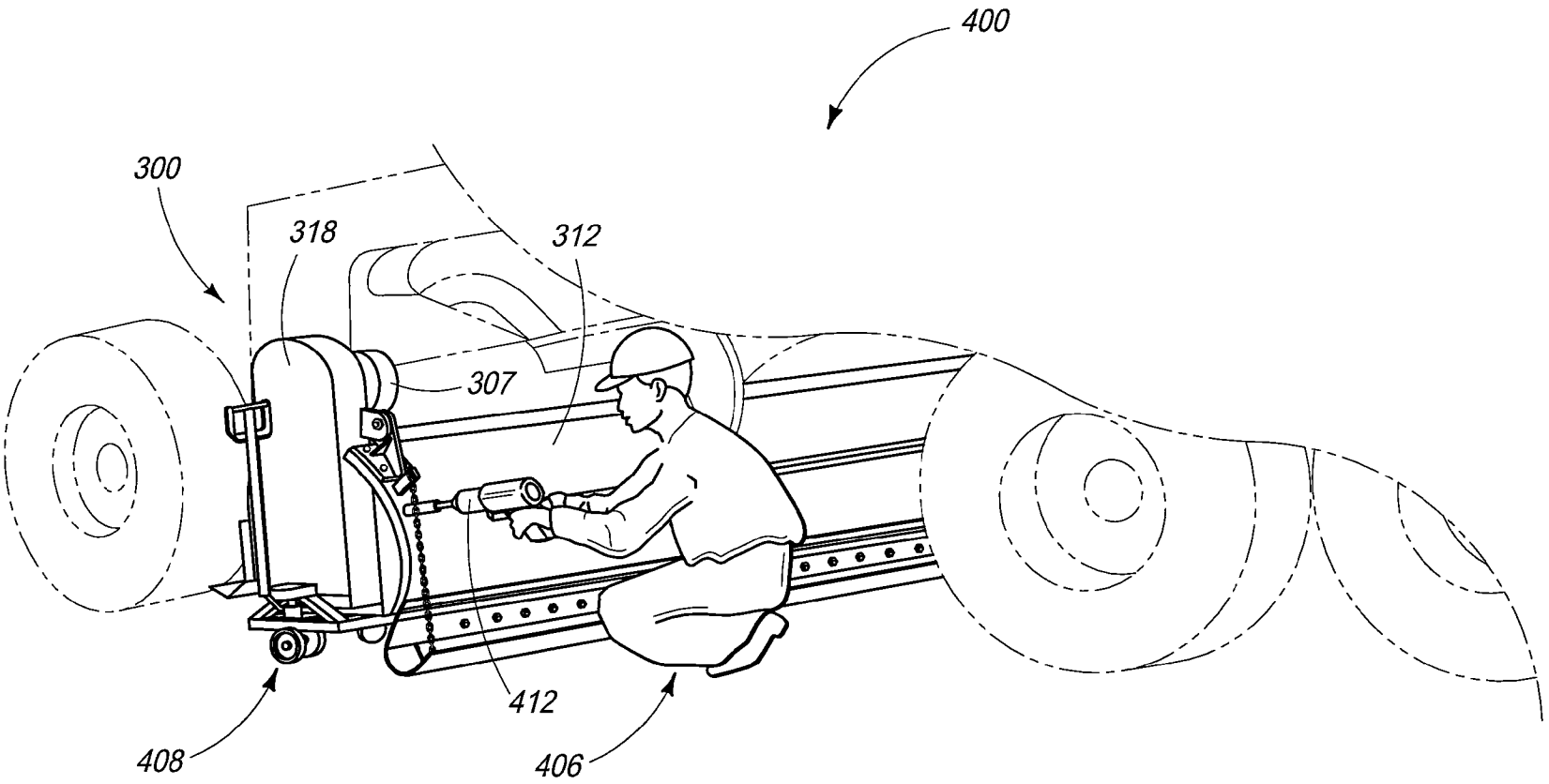
FIG. 43 is a fragmentary perspective view of the conventional road grader and the inventive grinder apparatus illustrating another exemplary method step of removing the grinder apparatus from the road grader according to one of various embodiments of the invention.

Referring to FIG. 43, another method step according to the invention includes individual 406 removing bolts from the end of blade 41 (moldboard) of the road grader 400.

Figure 44:
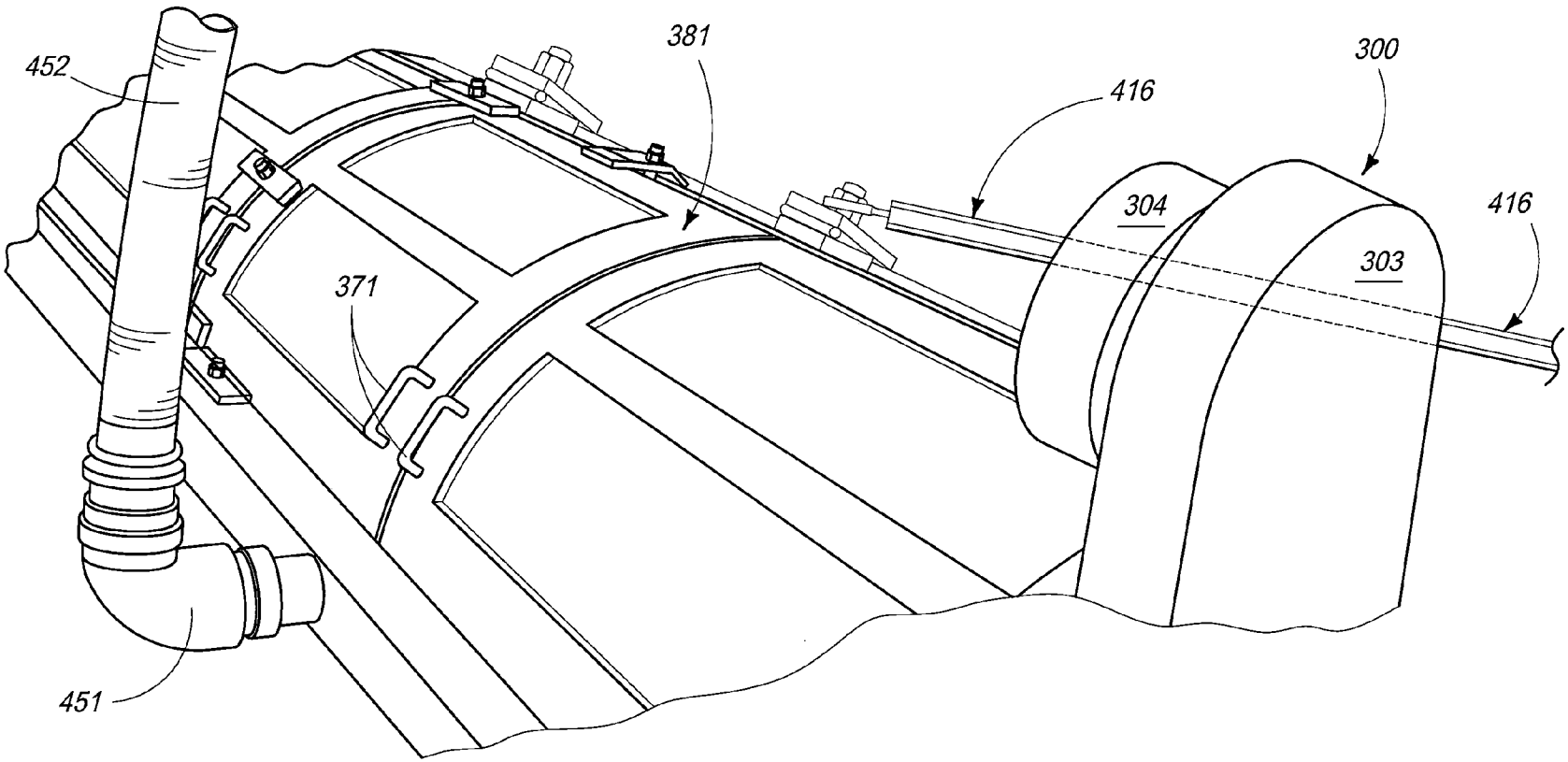
FIG. 44 is a fragmentary perspective view of the inventive grinder apparatus illustrating another exemplary method step of removing the grinder apparatus from the road grader according to one of various embodiments of the invention.

Referring to FIG. 44, another method step according to the invention includes individual 406 removing bolts from the top of blade 41 (moldboard) of the road grader 400 using a long, manual wrench 416.

Figure 45:
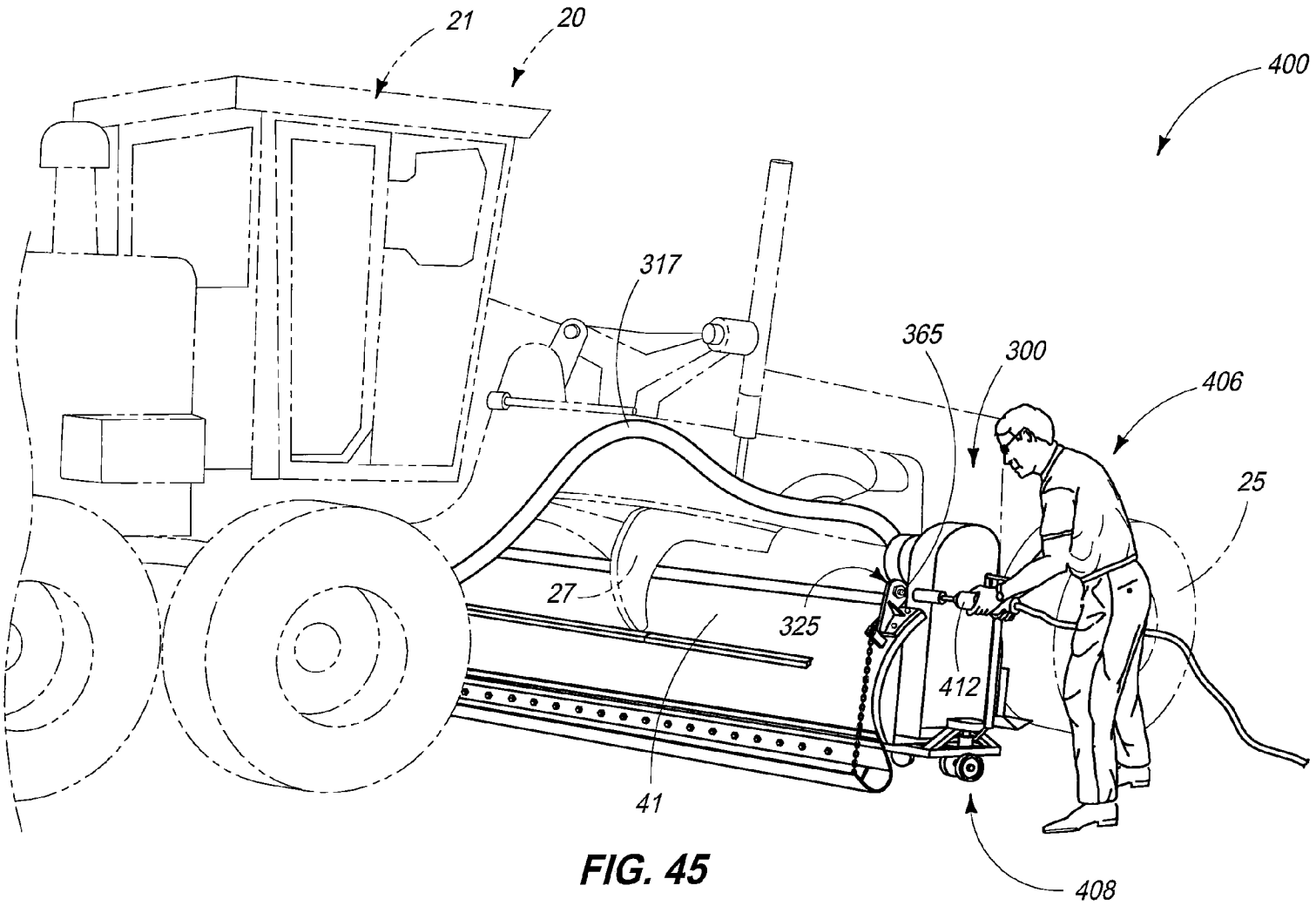
FIG. 45 is a fragmentary perspective view of the conventional road grader and the inventive grinder apparatus illustrating another exemplary method step of removing the grinder apparatus from the road grader according to one of various embodiments of the invention.

Referring to FIG. 45, another method step according to the invention includes individual 406 removing large bolts from each end of blade 41 (moldboard) of the road grader 400. In one embodiment, the large bolt from one end of moldboard 41 being removed is bolt 365 in the ear bracket 325 better illustrated in FIG. 8. On the opposite of grinder apparatus 300, a similarly positioned large bolt (not shown) is removed by individual 406.

Figure 46:
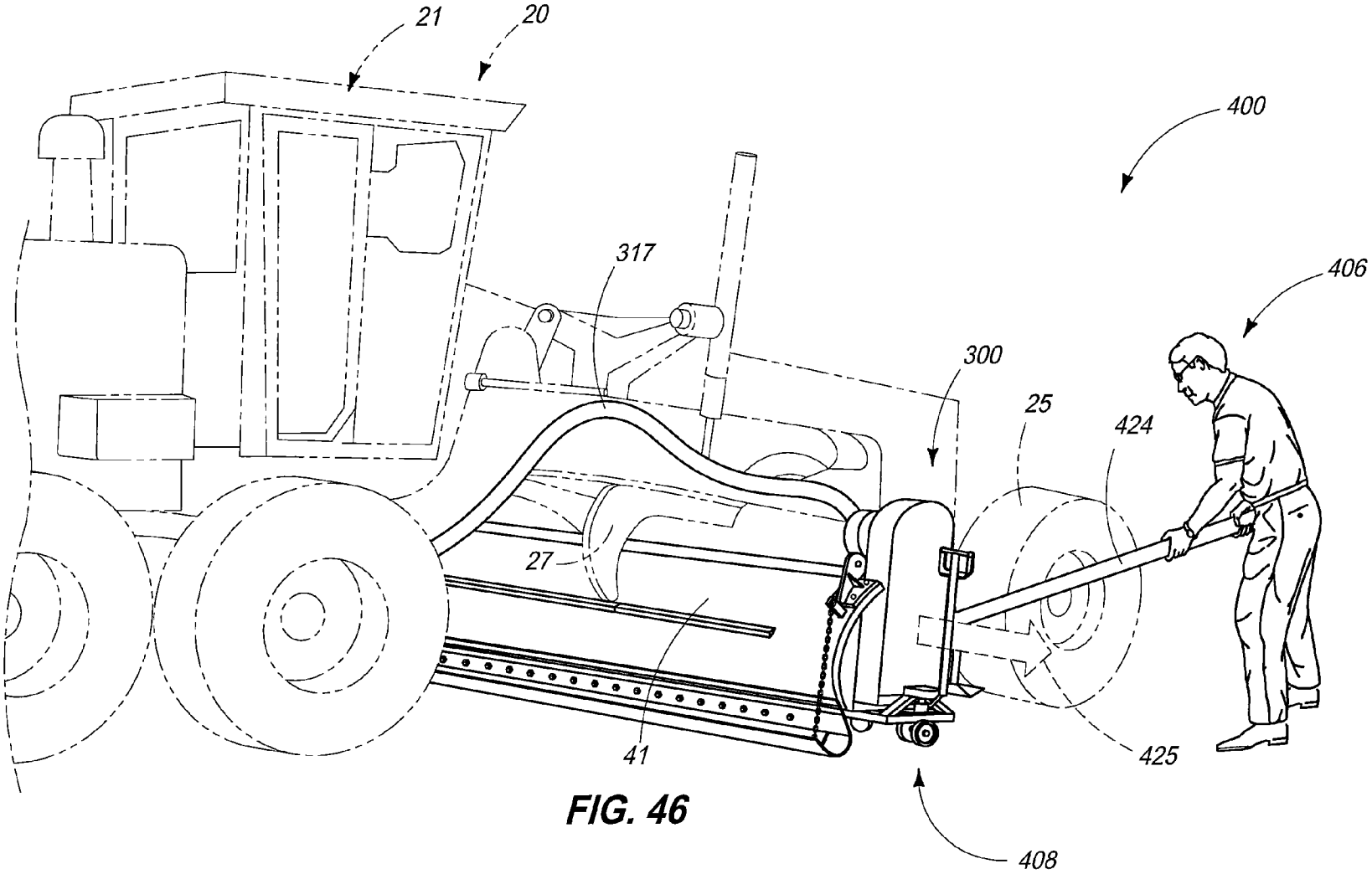
FIG. 46 is a fragmentary perspective view of the conventional road grader and the inventive grinder apparatus illustrating another exemplary method step of removing the grinder apparatus from the road grader according to one of various embodiments of the invention.

Referring to FIG. 46, another method step according to the invention includes individual 406 prying or wedging the grinder apparatus 300 from blade 41 (moldboard) of the road grader 400 using a pry bar 424. In another method step according to the invention, individual 406 can now move grinder apparatus 300 away from moldboard 41 using lift 408 and move grinder apparatus 300 along direction 425 from beneath road grader 400.

Figure 47:
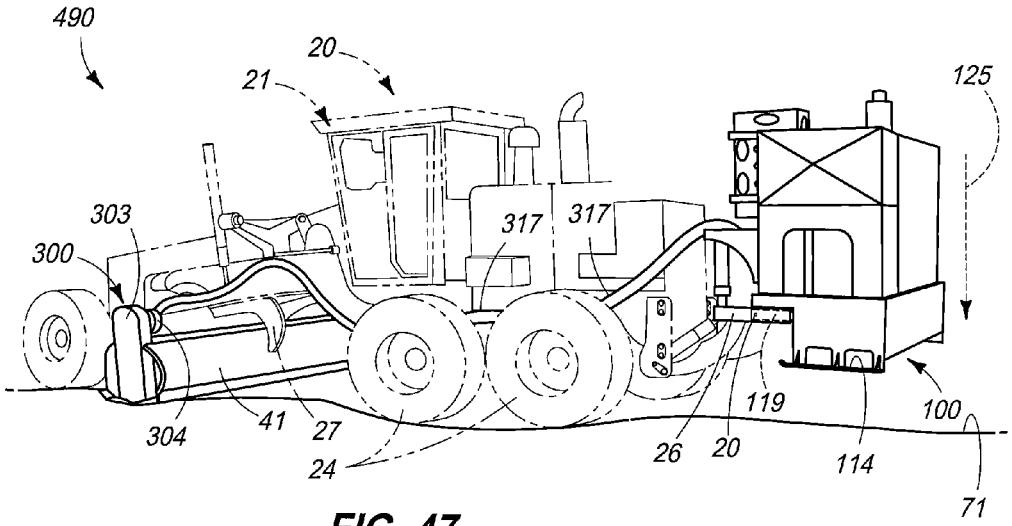
FIG. 47 is a perspective view of the conventional road grader and the inventive power system illustrating an exemplary method step of removing the power system from the road grader according to one of various embodiments of the invention.
Figure 48:
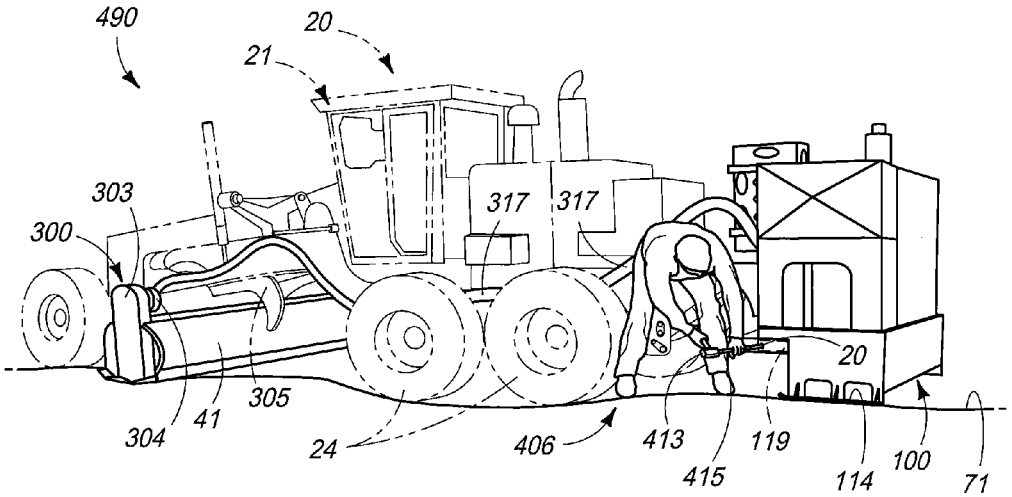
FIG. 48 is a perspective view of the conventional road grader and the inventive power system illustrating another exemplary method step of removing the power system from the road grader according to one of various embodiments of the invention.

Referring to FIGS. 47 and 48, an exemplary advantage of the inventive hydraulic power system 100 over the conventional (prior art) power systems is due to the simplicity and short span of time required for removing hydraulic power system 100 from the road grader 490. For one exemplary embodiment of the invention, the hydraulic power system 100 is secured to rear structure of the road grader 490 with bolts, which may or may not be the ripper 26. After removal of the bolts, the hydraulic power system 100 can be removed and/or lifted from the road grader 490 and placed on a substrate such as ground 71. A fork lift (not shown) can be used to lift and place the hydraulic power system 100. In still another embodiment of the invention, the inventive hydraulic power system 100 is secured to the ripper 26 of an exemplary road grader 490 and can be removed by a single person/individual in as small a length of time as a few minutes. Consequently, the method for removing hydraulic power system 100 from the road grader 490 is illustrated and described with respect to FIGS. 47 and 48.

Referring to FIG. 47, one method step according to the invention for removing hydraulic power system 100 includes an individual (not shown) lowering the hydraulic power system 100 along direction 125 until support shoes 114 are supporting hydraulic power system 100 upon the ground 71. Referring back to FIGS. 14-16, it should be remembered that hydraulic power system 100 has a support arm 119 with an opening 120. Moreover, it should be understood that when hydraulic power system 100 is supported upon ripper 26 of an exemplary road grader 490, ripper 26 has an opening 20 that is aligned with opening 120 wherein a pin (not shown) extends through openings 20 and 120 of respective hydraulic power system 100 and road grader 490 thereby securing hydraulic power system 100 to road grader 490.

Referring to FIG. 48, another method step according to the invention includes individual 406 placing one end of a driving bar 415 against the pin (not shown) that extends through openings 20 and 120 and aligning a hammer 413 against the opposite end f the driving bar 415. Another method step according to the invention includes striking the opposite end of driving bar 415 until the pin (not shown) is driven from openings 20 and 120 of respective hydraulic power system 100 and road grader 490. After the pin (not shown) is driven from openings 20 and 120, hydraulic power system 100 is no longer secured to road grader 490 and road grader 490 can be driven away from hydraulic power system 100 leaving hydraulic power system 100 resting upon the ground 71 via support shoes 114.

An exemplary disadvantage of the conventional (prior art) systems and apparatuses to service (repair and maintain) roadways is that during operation, large divots are left in the road and roadways. The large and long divots will cause depressions, potholes, ripples and ridges to return to the roadway surface in a short period of time even after the alleged repair procedure provided by the conventional (prior art) systems and apparatuses.

Figure 49:
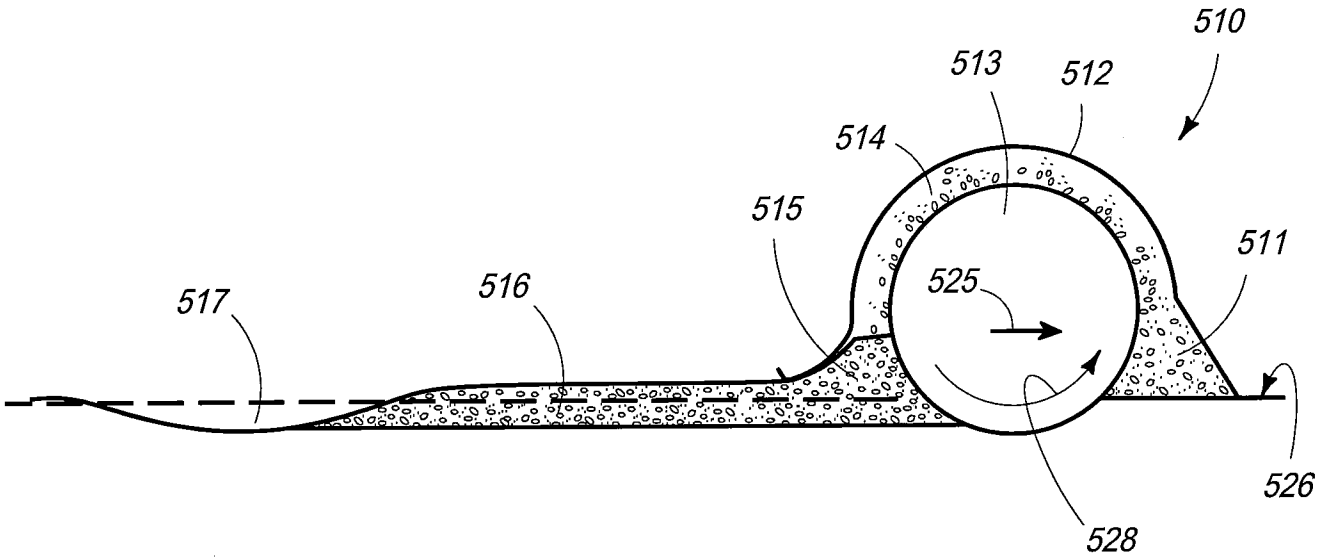
FIG. 49 is a simplified side view of the inventive grinder apparatus servicing an exemplary substrate according to one of various embodiments of the invention.

However, referring to FIG. 49, the inventive systems and apparatuses for servicing roadways disclosed throughout this document resolve this prior art problem. That is, the inventive systems and apparatuses during operation leave relatively small divots in the road and roadways. An inventive grinder apparatus 510 is shown (in simplistic form) having a drum 513 that is moving over roadway surface 526 along direction 525 while rotating counterclockwise 528. With this motion, drum 521 grounds/churns roadway surface 526 in front of drum 513 into material 511 and moves material 511 counterclockwise to flow over drum 513 in chamber 514 between drum 513 and protective shell 512. Ultimately, material 511 comes to rest upon roadway surface 526 behind drum 513 as materials 515 and 516. However, since inventive drum 513 has a smaller diameter relative the prior art drum 521, a relatively small divot 517 is left in roadway surface 526 which facilitates the prevention of roadway disrepair occurring quickly.

Exemplary advantages of the inventive apparatuses and systems for servicing (including maintaining and repairing) substrates and substrate surfaces that support heavy loads such as roads and roadways are now discussed. For example:

(1) Vegetation and ice removal from all road surfaces including shoulder areas of roadways. The inventive grinder apparatus 300 is capable of grinding, pulverizing, mixing and/or removing any materials of any sort that are located on, within and/or adjacent to road surfaces. For example, exemplary materials include naturally occurring and man-made materials such as, but not limited to, dirt, rocks, soil, vegetation, ice, asphalt, concrete and/or and any combination thereof.

(2) Low purchase prices. The inventive grinder apparatus 300 is priced significantly lower than conventional (prior art) apparatuses because the grinder apparatus 300 is designed as an attachment to a prime mover (self-propelled vehicle) such as a road grader that has been mass produced for decades. Moreover, the inventive grinder apparatus 300 is designed to be attached and detached quickly and easily. In contrast, prior art apparatuses directed to the capabilities and functionality of the inventive grinder apparatus 300 are routinely designed as a permanently attached structure to a prime mover. Accordingly, the prime mover loses its original versatility and capability and becomes dedicated only to projects that can be handled with the prior art apparatus permanently attached. This makes for expensive proposition when purchasing a prime mover that ends up having limited functionality and capability.

(3) Low operational costs. The inventive grinder apparatus 300 has a smaller diameter for the grinding drum (head) relative to prior art apparatuses which allows for lower horsepower requirements for the inventive grinder apparatus 300. Further, the inventive grinder apparatus 300 is more efficient having a wider grinding drum (head) than prior art apparatuses which allows for the inventive grinder apparatus 300 to require fewer passes over a substrate to finish a project. Still further, the inventive grinder apparatus 300 is designed to be attached to a prime mover capable of accurately adjusting the position of the grinding head in at least ten different orientations. These features of the grinder apparatus 300 and other inventions disclosed herein improve productivity while decreasing fuel usage which significantly lowers the cost of operation. Accordingly, the inventive grinder apparatus 300 and other inventions disclosed herein are not as detrimental to the environment as the prior art apparatuses, and therefore, offer a "Green" option to the roadway repair and maintenance industry.

(4) Operator Safety and Efficiency. The inventive grinder apparatus 300 can shift the grinder head to one side of the prime mover to reach and treat shoulders of a roadway that are located proximate an edge of an embankment. However, in contrast, prior art apparatuses attempting to accomplish this project have a tendency to roll over the embankment potentially resulting in great injure to the operator. In addition, the inventive grinder apparatus 300 is designed to allow the operator to observe and inspect the grinding head and the substrate being processed during operation. Consequently, the operator can make adjustments and corrections to the operation parameters immediately (that is, "on-the-fly") without interruption to the operation. Exemplary operation parameters that can be modified include adjustments in fluid content delivery, depth into substrate of mixing, consistency of mixing and lateral positioning of the grinder head to cover the ground surface efficiently. In contrast, prior art apparatuses require a man to be on the substrate (ground) to perform these tasks such as communicating to the machine operator the type of adjustments that are needed. Furthermore, safety is a concern with the prior art apparatuses because the man on the ground must avoid the prime mover and prior art apparatus during operation and any passing motor vehicles on the roadways.

(5) Public Safety. Since the inventive grinder apparatus 300 is an attachment to a road grader, it is more mobile and capable of moving out of the way of traffic than prior art apparatuses, and the grinder head itself can be shifted to one side of the roadway to allow vehicles to pass on the other side.

In compliance with the statute, the invention has been described in language more or less specific as to structural and methodical features. It is to be understood, however, that the invention is not limited to the specific features shown and described, since the means herein disclosed comprise various forms of putting the invention into effect. The invention is, therefore, claimed in any of its forms or modifications within the proper scope of the appended claims appropriately interpreted in accordance with the doctrine of equivalents.

The invention claimed is:

1. An apparatus for servicing roadways comprising:

a frame configured to be secured to a prime mover;

a grinding drum rotatably supported upon the frame, the grinding drum comprising a length dimension having a value from a range of about 9 feet to about 15 feet; and a driving system supported upon the frame and configured to rotationally drive the grinding drum;

wherein the grinding drum comprises an elongated, cylindrical structure that extends along a longitudinal axis, the longitudinal axis oriented at the center of the cylindrical structure of the grinding drum, the grinding drum configured for rotation about the longitudinal axis and configured for lateral movement along the longitudinal axis, and wherein the longitudinal axis has the same spatial orientation during the lateral movement of the grinding drum; and wherein the longitudinal axis represents an x-axis in three dimensional space, the grinding drum configured for at least partial rotation about the y-axis and at least partial rotation about the z-axis.

2. The apparatus of claim 1 wherein the driving system comprises two driving systems, one of the driving systems comprising a hydraulic motor configured to independently drive the grinding drum, and the other driving system comprising an electric motor configured to independently drive the grinding drum.

3. The apparatus of claim 1 further comprising at least one fluid flow device directed toward the grinding drum and configured to spray a fluid toward the grinding drum.

4. The apparatus of claim 3 wherein the at least one fluid flow device comprises a spray nozzle.

5. The apparatus of claim 1 further comprising a fluid flow system, the fluid flow system comprising:

a spray bar secured along at least a portion of a length of the grinding drum, the spray bar configured to receive a fluid and maintain the fluid under pressurized conditions;

a plurality of spray devices in fluid communication with the spray bar and configured to release a fluid toward the grinding drum; and a manifold configured to allow fluid to flow to selective ones of the plurality of the spray devices.

6. The apparatus of claim 1 wherein the length dimension of the grinding drum comprises a value of about 12 feet and 6 inches.

7. The apparatus of claim 1 wherein the grinding drum comprises an outer surface, and further comprising a plurality of projections removably secured to the outer surface of the grinding drum by bolts.

8. The apparatus of claim 1 wherein the driving system comprises:

a motor secured to the frame;

a first sprocket rotatably secured to the motor;

a second sprocket rotatably secured to the grinding drum; and a drive belt over the first and second sprockets.

9. The apparatus of claim 1 wherein the grinding drum comprises at least one of the following materials: plastics, fiberglass, polyethylene and composites of plastics.

10. The apparatus of claim 1 wherein the grinding drum comprises a diameter dimension having a value from a range of about 6 inches to about 50 inches.

11. The apparatus of claim 1 wherein the grinding drum is configured to be removed from the prime mover by a single person/individual in a length of time ranging from about two hours to about three hours.

12. An apparatus for servicing roadways comprising:

prime mover;

a grinding drum secured to the prime mover and comprising an elongated, cylindrical structure that extends along a longitudinal axis, the longitudinal axis oriented at the center of the cylindrical structure of the grinding drum, the grinding drum configured for rotation about the longitudinal axis; and with the longitudinal axis representing an x-axis in three dimensional space, the grinding drum configured for at least partial rotation about the y-axis and at least partial rotation about the z-axis, wherein the grinding drum is configured to move laterally along the longitudinal axis with an end of the grinding drum positioned outwardly of an imaginary line extending between a front wheel and a rear wheel of one side of the prime mover, and wherein the longitudinal axis has the same spatial orientation during the lateral movement of the grinding drum.

13. The apparatus of claim 12 wherein a length dimension of the grinding drum along the longitudinal axis comprises a value from a range of about 5 feet to about 25 feet and the range includes any dimension between 5 feet and 25 feet having incremental differences of one inch.

14. The apparatus of claim 12 further comprising an electric motor configured to rotate the grinding drum about the longitudinal axis.

15. The apparatus of claim 12 wherein the intersecting point between the x-axis, y-axis and z-axis is configured to remain at the same point in space relative the prime mover during all the rotations and the lateral movement of the grinding drum.

16. The apparatus of claim 12 wherein the grinding drum comprising a length dimension having a value from a range of about 9 feet to about 15 feet.

17. The apparatus of claim 16 wherein the length dimension comprises a value of about 12 feet and 6 inches, 18. The apparatus of claim 12 wherein the grinding drum comprises a diameter dimension having a value from a range of about 6 inches to about 50 inches.

19. The apparatus of claim 12 wherein the grinding drum is configured to be removed from the prime mover by a single person/individual in a length of time ranging from about two hours to about three hours.

* * * * *

UNITED STATES PATENT AND TRADEMARK OFFICE

CERTIFICATE OF CORRECTION

PATENT NO. : 9,011,039 B2
APPLICATION NO. : 13/071278
DATED : April 21, 2015
INVENTOR(S) : Tom L. Oxford et al.

It is certified that error appears in the above-identified patent and that said Letters Patent is hereby corrected as shown below:

In the Specification

Column 9, line 12 – Replace "exemplar ear bracket" with
--exemplary ear bracket--

Column 10, line 28 – Replace "materials such carbide" with
--materials such as carbide--

Column 18, line 31 – Replace "could be extend" with
--could be extended--

Column 18, line 40 – Replace "could be extend farther" with
--could be extended farther--

Column 19, lines 46-47 – Replace "after all other structure is" with
--after all other structures are--

Column 20, line 53 – Replace "opposite end f the driving bar" with
--opposite end of the driving bar--

Column 22, line 11-12 – Replace "great injure to the operator." with
--great injury to the operator.--

Signed and Sealed this
Fifth Day of April, 2016

Michelle K. Lee

Michelle K. Lee
*Director of the United States Patent and Trademark Office*